US006580897B2

(12) United States Patent
Sato et al.

(10) Patent No.: US 6,580,897 B2
(45) Date of Patent: Jun. 17, 2003

(54) CLEANING DEVICE, AND IMAGE FORMING METHOD AND IMAGE FORMING APPARATUS USING THE CLEANING DEVICE

(75) Inventors: Kazuhiko Sato, Tokyo (JP); Junichi Koiso, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/934,168

(22) Filed: Aug. 21, 2001

(65) Prior Publication Data

US 2002/0044808 A1 Apr. 18, 2002

Related U.S. Application Data

(63) Continuation-in-part of application No. 09/738,437, filed on Dec. 15, 2000.

(30) Foreign Application Priority Data

Dec. 20, 1999 (JP) ..... 11-361049
Jul. 18, 2000 (JP) ..... 2000-217504
Aug. 23, 2000 (JP) ..... 2000-252368

(51) Int. Cl.[7] ..... G03G 21/00
(52) U.S. Cl. ..... 399/350
(58) Field of Search ..... 399/343, 350, 399/351; 15/1.51, 256.5

(56) References Cited

U.S. PATENT DOCUMENTS 3,848,992 A * 11/1974 Smith ..... 399/350
4,255,044 A * 3/1981 Cormier et al. ..... 399/351 X
4,264,191 A * 4/1981 Gerbasi et al. ..... 399/350 X
4,823,161 A * 4/1989 Yamada et al. ..... 399/350
4,875,081 A * 10/1989 Goffe et al. ..... 399/343
5,765,088 A * 6/1998 Nakayama et al. ..... 399/350
6,021,304 A * 2/2000 Sbert et al. ..... 399/350 X
6,296,980 B1 * 10/2001 Oshiba et al.

FOREIGN PATENT DOCUMENTS

JP 57-133470 * 8/1982
JP 57-211183 * 12/1982
JP 59-030574 2/1984
JP 08-083028 * 3/1996
JP 09-258460 10/1997

* cited by examiner

*Primary Examiner*—Sandra Brase
(74) *Attorney, Agent, or Firm*—Frishauf, Holtz, Goodman & Chick, P.C.

(57) ABSTRACT

A cleaning device removing residual toner from a photoreceptor. The cleaning device has a cleaning blade composed of a plurality of plate materials laminated together. The plate materials include a cleaning blade member and a plastic member each of which is mounted on a support. In use, the cleaning blade member is brought into contact with the photoreceptor; however, the plastic member is not brought into contact with the photoreceptor. The elastic modulus of the cleaning blade $D_1$ and the elastic modulus of the plastic member $D_2$ satisfy the following formula $16 \leqq D_2/D_1 \leqq 2,800$.

14 Claims, 11 Drawing Sheets

FIG. 13 ( a )
TONER HAVING NO CORNERS
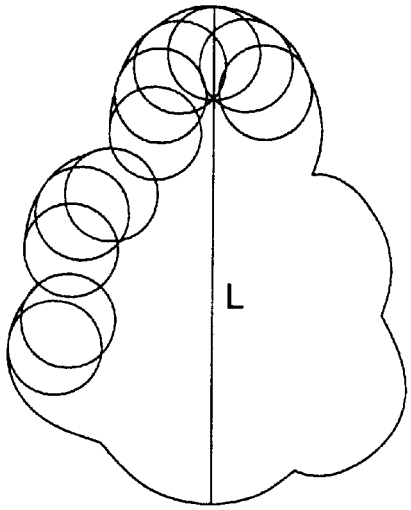
FIG. 13 ( b )
TONER HAVING CORNERS
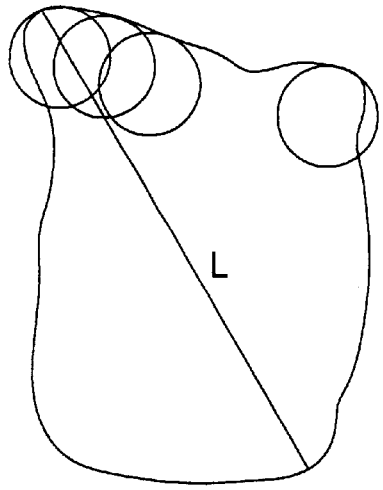
FIG. 13 ( c )
TONER HAVING CORNERS
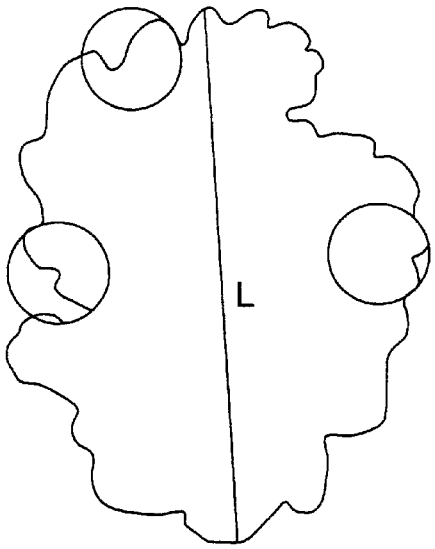

CLEANING DEVICE, AND IMAGE FORMING METHOD AND IMAGE FORMING APPARATUS USING THE CLEANING DEVICE

This is a continuation-in-part of Ser. No. 09/738,437 filed on Dec. 15, 2000.

FIELD OF THE INVENTION

The invention relates to a cleaning device to be used in a electrophotographic copy machine or a printer, and an image forming method and an image forming apparatus using the cleaning device.

BACKGROUND OF THE INVENTION

Recently, an organic photoreceptor, hereinafter referred to a photoreceptor, containing an organic photoconductive substance is most widely used as an image carrier to be used in an electrophotographic image forming apparatus. The organic photoreceptor has advantages over another photoreceptor in that the organic photoreceptor responding various light sources from visible rays through infrared rays can be easily developed, a material without environment pollution can be selected and the material can be produced with a low cost. However, the organic photoreceptor has a shortcoming that such the photoreceptor is weak in the mechanical strength and tens to occur a degradation or formation of damage on the photoreceptor surface when the photoreceptor is subjected to many times of copying or printing operations.

Moreover, a remaining toner remained on the photoreceptor after transfer of the toner image to an image receiving member is difficultly removed since the contact energy of the photoreceptor with the toner for developing the electrostatic latent image formed on the photoreceptor is large. Consequently, various problems tend to be raised on the cleaning of the photoreceptor surface.

Besides, in the electrophotographic image forming method, a digital method is become the main current of the image formation technology accompanied with the progress in the digital technology. It is standardized in the digital image formation that a fine dot image of one pixel such as 400 dots per inch (dpi) is made actual image. Accordingly, a high quality image forming technology is required by which such the fine dot image can be reproduced with a high fidelity.

On the other hand, various methods for raising the mechanical strength of the photoreceptor surface have been proposed as a countermeasure against the degradation of the organic photoreceptor surface accompanied with the cleaning.

Japanese Patent Publication Open to Public Inspection No. 9-258460 proposes a photoreceptor having a surface layer of polycarbonate resin having a high hardness for reducing the surface abrasion. Such the photoreceptor having the polycarbonate resin layer is different from the usual photoreceptor in that the friction force between a cleaning blade, hereinafter simply referred to a blade and the surface of photoreceptor, since the surface abrasion of the photoreceptor by the cleaning is small. Consequently, an incompletely cleaning tends to be occurred by the turning over of the blade and the toner slipping through the blade caused by vibration of the blade.

Another one of the methods is technology regarding the production of toner. Currently, a crushed toner is mainly used to form an electrophotographic image, which is produced by mixing and kneading binder resin and pigment, and crushing the kneaded mixture to prepare a toner powder and classifying the crushed powder. However, there is a limit on the unifying of the size of such the toner particles, and the uniformities of the size and the shape of the toner particles are insufficient. It is difficult to achieve a sufficient high quality of image by an electrophotography using such the crushed toner.

Recently, an electrophotographic developer or an image forming method using a polymerized toner is proposed as a means to unify the size and the shape of the toner particles. The polymerized toner is produced by dispersing a raw material toner in an aqueous medium and polymerizing the dispersed monomer, thus a toner can be obtained composed of particles unformed in the size and the shape thereof.

However, a technical problem is newly raised when the polymerized toner is used in an image forming apparatus having the organic photoreceptor. The polymerized toner is produced so that the particles each have an approximately spherical shape since the shape of the toner is formed in the course of the polymerization of the toner. As well-known, the spherical toner remaining on the photoreceptor tends to cause incomplete cleaning. Particularly, the surface of the organic photoreceptor is easily abraded and slipping of the fine toner particle through the blade in a degree so as to form no image are occurred during a long period of time when the toner is adhered in the irregularities of the surface formed by the abrasion. The toner particles slipped through the blade contaminate a charging member such as a charging wire and a charging roller and an unevenness of the image is formed in the halftone image.

Various methods have been proposed for improving the incompletion of cleaning such as the turning over of the blade and the toner slipping through the blade in the image forming method using the polymerized toner. Among them, a proposal to change the shape of the toner particle from the spherical shape to an ellipse shape and that to make irregular the surface of the toner particle are tried. However, these proposals cannot be sufficient solving means.

SUMMARY OF THE INVENTION

The object of the invention is to solve the foregoing problems and to provide a cleaning device, and an image forming method and an image forming apparatus using the cleaning device, by which the cleaning effect is maintained for a long period of time and a good electrophotographic image can be obtained without any fault in image.

It is found by the inventors that a good cleaning property can be maintained and a stable vibration of the blade can be kept by sticking a plastic member to the cleaning blade, and the foregoing problems can be solved.

The invention and the embodiment thereof are described below.

1. A cleaning device removing residual toner on a photoreceptor wherein the cleaning device comprises a cleaning blade composed of a plurality of plate materials laminated each other, the plurality of plate materials including a cleaning blade member and a plastic member each of which is mounted on a support member, the cleaning blade member being brought into contact with said photoconductor and the plastic member not being brought into contact with said photoconductor, wherein elastic modulus of the cleaning blade $D_1$ and the elastic modulus of the plastic member $D_2$ satisfy $$16 \leq D_2/D_1 \leq 2{,}800.$$

2. The cleaning device of item 1 wherein tensile strength H of the plastic member satisfies $$1.4 \leqq H \leqq 35 \text{ (H: kgf/mm}^2\text{)}.$$

3. The cleaning device of item 1 wherein bending strength M of the plastic member satisfies $$0 \leqq M \leqq 41 \text{ (M: kgf/mm}^2\text{)}.$$

4. The cleaning device of item 1 wherein length $L_1$ of the cleaning blade member is longer than length $L_2$ of the plastic member.

5. The cleaning device of item 1 wherein the cleaaning member and the plastic member are laminated with an adhesive layer.

6. The cleaning device of item 1, wherein the cleaning device satisfies;

$$0.1 \leqq L2/L1 \leqq 0.9$$

wherein $L_1$ is a free length of the cleaning blade member and L2 is a free length of the plastic member, $$1/50 < t_2/t_2 < 1$$

wherein $t_1$ is a thickness of the cleaning blade member and $t_2$ is a thickness of the plastic member, and $$1.4 \leqq H \leqq 35 \text{ (H: kgf/mm}^2\text{)}.$$

wherein H is tensile strength of the plastic member.

7. The cleaning device of item 1, wherein the cleaning device satisfies;

$$0.1 < L2/L1 \leqq 0.9$$

wherein L1 is a free length of the cleaning blade member and L2 is a free length of the plastic member, $$1/50 < t_2/t_1 < 1$$

wherein $t_1$ is a thickness of the cleaning blade member and $t_2$ is a thickness of the plastic member, and $$0 < M \leqq 41 \text{ (M: kgf/mm}^2\text{)}$$

wherein bending M is bending strength of the plastic member.

8. The cleaning device of item 6 wherein L2/L1 is 0.3 to 0.7.

9. A cleaning device removing residual toner on a photoreceptor wherein the cleaning apparatus comprises a cleaning blade composed of a plurality of plate material laminated each other, the plurality of plate material including a cleaning blade member and a plastic member each of which is mounted on a support member, the cleaning blade member being brought into contact with said photoconductor and the plastic member not being brought into contact with said photoconductor, wherein length $L_1$ of the cleaning blade member is longer than length $L_2$ of the plastic member.

10. The cleaning device of item 9 wherein each of the plurality of plate materials is laminated with an adhesive layer.

11. The cleaning device of item 9 wherein elastic modulus of the cleaning blade $D_1$ and the elastic modulus of the plastic member $D_2$ satisfy $$16 \leqq D_2/D_1 \leqq 2{,}800.$$

12. The cleaning device of item 10 wherein the cleaning blade satisfies one of following conditions;

$$0.1 < L2/L1 \leqq 0.9$$

wherein L1 is free length of a cleaning blade member and L2 is free length of a plastic member, $$1/50 < t_2/t_1 < 1$$

wherein $t_1$ is thickness of the cleaning blade member and $t_2$ is thickness of the plastic member, $$1.4 \leqq H \leqq 35 \text{ (H: kgf/mm}^2\text{)}$$

wherein H is tensile strength of the plastic member.

13. An image forming method comprising steps of exposing a photoreceptor uniformly, imagewise exposing to form a latent image, developing the latent image by toner to form a toner image, transferring the toner image to a recording material, fixing transferred toner image and cleaning a residual toner on the photoreceptor by a cleaning device, wherein the cleaning device comprises a cleaning blade composed of a plurality of plate materials laminated each other, the plurality of plate material including a cleaning blade member and a plastic member each of which is mounted on a support member, the cleaning blade member being brought into contact with said photoconductor and the plastic member not being brought into contact with said photoconductor, and the cleaning blade satisfies one of following conditions;

$$0.1 < L2/L1 \leqq 0.9$$

wherein L1 is free length of a cleaning blade member and L2 is free length of a plastic member, $$1/50 < t_2/t_1 < 1$$

wherein $t_1$ is thickness of the cleaning blade member and $t_2$ is thickness of the plastic member, and $$1.4 \leqq H \leqq 35 \text{ (H: kgf/mm}^2\text{)}$$

wherein H is tensile strength of the plastic member.

14. An image forming method comprising steps of exposing a photoreceptor uniformly, imagewise exposing to form a latent image, developing the latent image by toner to form a toner image, transferring the toner image to a recording material, fixing transferred toner image and cleaning a residual toner on the photoreceptor by a cleaning device, wherein the cleaning device comprises a cleaning blade composed of a plurality of plate materials laminated each other, the plurality of plate material including a cleaning blade member and a plastic member each of which is mounted on a support member, the cleaning blade member being brought into contact with said photoconductor and the plastic member not being brought into contact with said photoconductor, and the cleaning blade satisfies one of following conditions;

$$0.1 < L2/L1 \leqq 0.9$$

wherein L1 is free length of a cleaning blade member and L2 is free length of a plastic member, $$1/50 < t_2/t_1 < 1$$

wherein $t_1$ is thickness of the cleaning blade member and $t_2$ is thickness of the plastic member, and $$0 < M \leqq 41 \text{ (M: kgf/mm}^2\text{)}$$

wherein bending M is bending strength of the plastic member.

15. An image forming method of item 12 wherein toner has the variation coefficient of the shape coefficient of toner particles of not more than 16 percent, and the number variation coefficient of the number size distribution of said toner particles of not more than 27 percent.

16. An image forming apparatus comprising a photoreceptor, exposing unit to form a latent image on the photoreceptor, developing unit to visualize toner image, transferring unit to transfer visualized toner image to a recording material, fixing transferred toner image on the recording material and cleaning device to clean a residual toner on the photoreceptor, wherein the cleaning device comprises a cleaning blade composed of a plurality of plate materials laminated each other, the plurality of plate material including a cleaning blade member and a plastic member each of which is mounted on a support member, the cleaning blade member being brought into contact with said photoconductor and the plastic member not being brought into contact with said photoconductor, and the cleaning blade satisfies one of following conditions;

$$0.1<L2/L1\leqq 0.9$$

wherein L1 is free length of a cleaning blade member and L2 is free length of a plastic member, $$1/50<t_2/t_1<1$$

wherein $t_1$ is thickness of the cleaning blade member and $t_2$ is thickness of the plastic member, $$1.4\leqq H\leqq 35\ (H:\ kgf/mm^2)$$

wherein H is tensile strength of the plastic member.

17. The image forming apparatus of item 14 wherein contact angle θ of the cleaning blade member against the photoreceptor is not less than 10 degree.

Another embodiment of the invention is described below:

1. A cleaning device having a cleaning blade for removing the toner remained on an organic photoreceptor after a toner image formed on the organic photoreceptor by developing an electrostatic latent image formed on the organic photoreceptor by a developer containing a toner is transferred to an image receiving member, wherein the cleaning device has a cleaning blade and a plastic member and the cleaning blade is contacted with the plastic member on the surface of the cleaning blade opposite to the surface of the cleaning blade to be contacted to the organic photoreceptor, and the front edge of the cleaning blade and the front edge of the plastic member are arranged to form a level difference so that the position of the front edge of the plastic member is farther than the position of the front edge of the cleaning blade from the organic photoreceptor.

2. A cleaning device having a cleaning blade for removing the toner remained on an organic photoreceptor after a toner image formed on the organic photoreceptor by developing an electrostatic latent image formed on the organic photoreceptor by a developer containing a toner is transferred to an image receiving member, wherein the cleaning device has a cleaning blade and a plastic member and the cleaning blade is contacted with the plastic member on the surface of the cleaning blade opposite to the surface of the cleaning blade to be contacted to the organic photoreceptor, and the free length of the cleaning blade L1 and the free length of the plastic member L2 satisfy the following formula 1:

Formula 1

$$0.1<L2/L1\leqq 0.9.$$

3. A cleaning device having a cleaning blade for removing the toner remained on an organic photoreceptor after a toner image formed on the organic photoreceptor by developing an electrostatic latent image formed on the organic photoreceptor by a developer containing a toner is transferred to an image receiving member, wherein the cleaning device has a cleaning blade and a plastic member and the cleaning blade is contacted with the plastic member on the surface of the cleaning blade opposite to the surface of the cleaning blade to be contacted to the organic photoreceptor, and the thickness of the cleaning blade $t_1$ and the thickness of the plastic member $t_2$ satisfy the following formula 2:

Formula 2

$$1/5\leqq t_2/t_1\leqq 1.$$

4. A cleaning device having a cleaning blade for removing the toner remained on an organic photoreceptor after a toner image formed on the organic photoreceptor by developing an electrostatic latent image formed on the organic photoreceptor by a developer containing a toner is transferred to an image receiving member, wherein the cleaning device has a cleaning blade and a plastic member and the cleaning blade is contacted with the plastic member on the surface of the cleaning blade opposite to the surface of the cleaning blade to be contacted to the organic photoreceptor, and the elastic modulus of the cleaning blade $D_1$ and the elastic modulus of the plastic member $D_2$ satisfy the following formula 3:

Formula 3

$$16\leqq D_2/D_1\leqq 2{,}800.$$

5. A cleaning device having a cleaning blade for removing the toner remained on an organic photoreceptor after a toner image formed on the organic photoreceptor by developing an electrostatic latent image formed on the organic photoreceptor by a developer containing a toner is transferred to an image receiving member, wherein the cleaning device has a cleaning blade and a plastic member and the cleaning blade is contacted with the plastic member on the surface of the cleaning blade opposite to the surface of the cleaning blade to be contacted to the organic photoreceptor, and the tensile strength H of the plastic member satisfies the following formula 4:

Formula 4

$$1.4\leqq H\leqq 35\ (H:\ kgf/mm^2).$$

6. A cleaning device having a cleaning blade for removing the toner remained on an organic photoreceptor after a toner image formed on the organic photoreceptor by developing an electrostatic latent image formed on the organic photoreceptor by a developer containing a toner is transferred to an image receiving member, wherein the cleaning device has a cleaning blade and a plastic member and the cleaning blade is contacted with the plastic member on the surface of the cleaning blade opposite to the surface of the cleaning blade to be contacted to the organic photoreceptor, and the bending strength M of the plastic member satisfies the following formula 5:

Formula 5

$$0<M\leqq 41\ (M:\ kgf/mm^2).$$

7. A cleaning device having a cleaning blade for removing the toner remained on an organic photoreceptor after a toner image formed on the organic photoreceptor by developing an electrostatic latent image formed on the organic photoreceptor by a developer containing a toner is transferred to an image receiving member, wherein the cleaning device has a cleaning blade and a plastic member and the cleaning blade is contacted with the plastic member on the surface of the cleaning blade opposite to the surface of the cleaning blade to be contacted to the organic photoreceptor, and the front edge of the cleaning blade and the front edge of the plastic member are arranged to form a level difference so that the position of the front edge of the plastic member is farther than the position of the front edge of the cleaning blade from the position of the organic photoreceptor, and the cleaning blade and the plastic member satisfy the foregoing formula 1 through formula 5.

8. An image forming method comprising the steps of developing a static latent image formed on an organic photoreceptor by a developer containing a toner, transferring the toner image developed by the development onto an image receiving member, and removing the toner remained on the organic photoreceptor by the cleaning device described in any one of the foregoing 1 through 7.

9. An image forming apparatus in which a static latent image formed on an organic photoreceptor is developed by a developer containing a toner, the toner image developed by the development transferred onto a image receiving member, and the toner remained on the organic photoreceptor is removed by the cleaning device described in any one of the foregoing 1 through 7.

10. An image forming apparatus in which a toner is used which has a variation coefficient of the shape coefficient of the toner particles of not more than 16% and a number variation coefficient of the particle size distribution of the toner particles of not more than 27%.

11. An image forming apparatus in which a toner containing toner particles having a shape coefficient of from 1.2 to 1.6 in a ratio of not less than 65% in number is used.

12. An image forming apparatus in which a toner containing toner particles each having no corner in a ratio of not less than 50% in number is used.

13. An image forming apparatus in which a toner having the organic photoreceptor comprising an electro conductive substrate and a photoreceptive layer provided on the substrate, and the surface layer of the photoreceptive layer contains polycarbonate having an average molecular weight of not less than 40,000.

BRIEF DESCRIPTION OF THE DRAWINGS

FIG. 13(*a*) is an explanatory view showing a projection image of toner particle having no corners. FIGS. 13(*b*) and 13(*c*) are explanatory views showing projection images of toner particles having corners.

DETAILED DESCRIPTION OF THE INVENTION

It is found by the inventors that the frictional force generated between the toner remaining on the organic photoreceptor and the cleaning blade is not made excessive and the turning over the blade and the slipping off the toner are inhibited and the toner remained on the organic photoreceptor can be effectively removed so as to stably form a good image for a long period of time by applying the foregoing constitution according to the invention. The invention is described in detail below.

Figure 1:
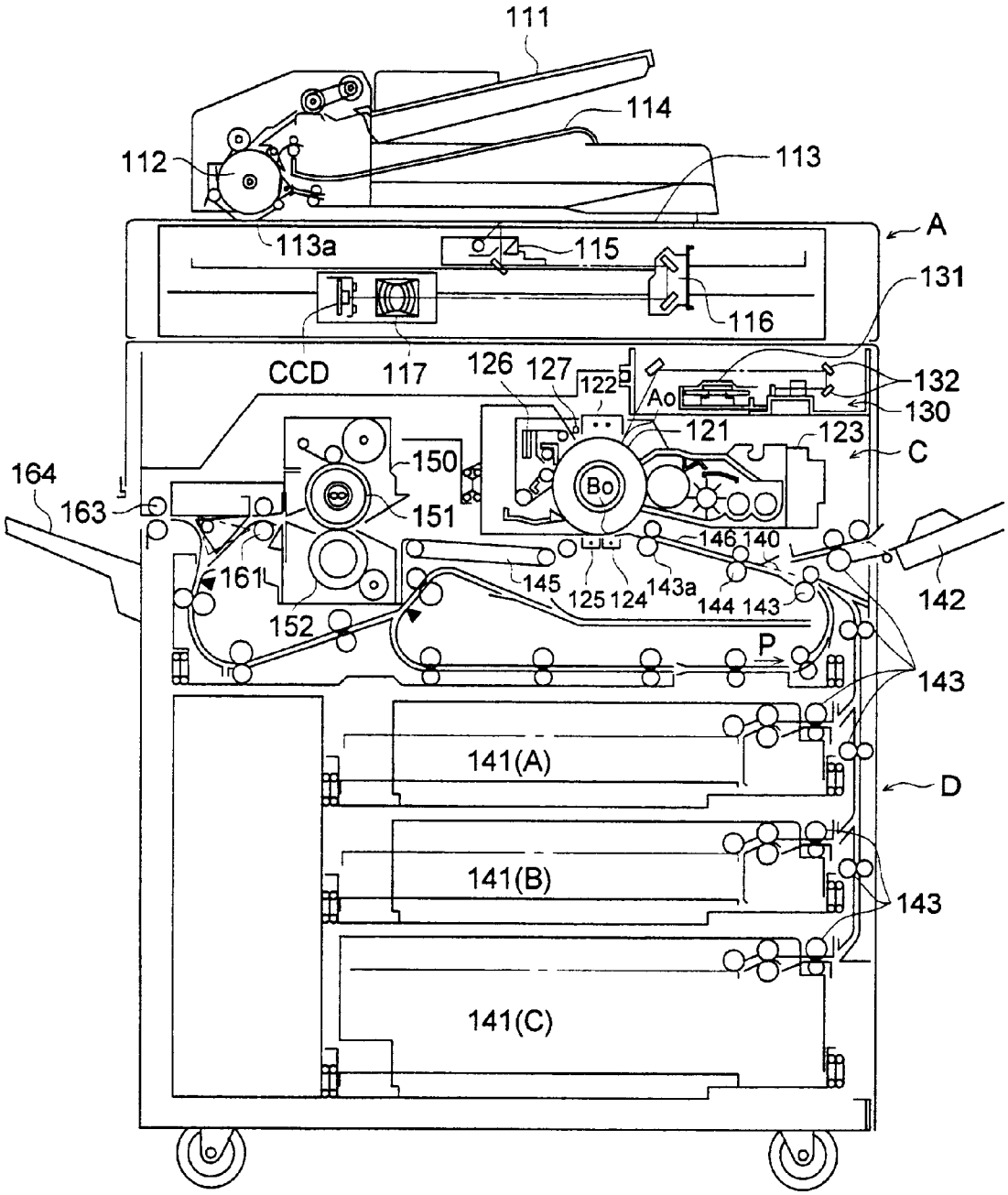
FIG. 1 is a schematic view showing the entire configuration of the image forming apparatus of the present invention.

FIG. 1 is a schematic view showing the entire structure of the image forming apparatus of the present invention.

The image forming apparatus shown in FIG. 1 is one employing a digital system, and is comprised of image reading section A, image processing section B (not shown), image forming section C, and transfer paper conveying section D as the transfer paper conveying means.

In the upper part of image reading section A, provided is an automatic document conveying means which automatically conveys the original documents. Original documents, which are placed on document platen 111, are conveyed sheet by sheet and conveyed by original document conveying roller 112, and image reading is carried out at reading position 113*a*. The original document, which has been read, is ejected onto document ejecting tray 114, utilizing document conveying roller 112.

On the other hand, the image of the original document, which is placed on platen glass 113, is read by reading operation at a speed of v of first mirror unit 115 comprised of an illuminating lamp and a first mirror which constitutes an optical scanning system and by movement at a speed of v/2 in the same direction of second mirror unit 116 comprised of a second mirror and a third mirror which are positioned in a V letter.

The read image is focused through projection lens 117 onto the receptor surface of imaging sensor CCD of a line sensor. The linear optical image, which has been focused onto the imaging sensor CCD, is successively subjected to photoelectric conversion to obtain electric signals (brightness signals), and thereafter, is subjected to A/D conversion. The resultant signals are then subjected to various processes such as density conversion, a filtering process, and the like in image processing section and then the resultant image data are temporarily stored in a memory.

In image forming section C, arranged as image forming units are drum-shaped image bearing photoreceptor (hereinafter referred to as a photoreceptor drum) 121, and around said photoreceptor drum, charging unit 122 as the charging means, development unit 123 as the development means, transfer unit 124 as the transfer means, separating unit 125 as the separating means, cleaning device 126 and PCL (pre-charge lamp) 127 in said order for each cycle. Photoreceptor 121 is prepared by applying photoconductive compounds onto a drum base body. For example, organic photoconductors (OPC) are preferably employed. Said drum rotates clockwise as shown in FIG. 1.

After rotating the photoreceptor is uniformly charged employing charging unit 122, image exposure is carried out based on image signals retrieved from the memory of image processing section B, employing exposure optical system 130. In said exposure optical system 130 which is utilized as the writing means, a laser diode (not shown) is employed as the light emitting source, and primary scanning is carried out in such a manner that light passes through rotating polygonal mirror 131, an fθ lens (having no reference numeral), and a cylindrical lens (also having no reference numeral), and the light path is deflected by reflection mirror 132. As a result, image exposure is carried out at position $A_0$ with respect to photoreceptor 121, and a latent image is formed by the rotation (secondary scanning) of photoreceptor 121. In one example of the present embodiment, exposure is carried out for a text section and the latent image is formed.

The latent image on photoreceptor 121 is subjected to reversal development employing development unit 123, and a visualized toner image is formed on the surface of said photoreceptor 121. In transfer sheet conveying section D, under the image forming unit provided are sheet supply units 142(A), 141(B), and 141(C) as paper sheet storing means, in which different-sized paper sheets P are stored, and provided on the exterior, is manual paper sheet supply unit 142 by which paper sheets are manually supplied. Paper sheet P, which is selected from any of these paper sheet supply units is conveyed along conveying path 140 employing paired guide rollers 143, and the conveyance of the paper sheet P is temporarily suspended by paired register rollers 144 which correct the inclination as well as the deviation of the paper sheet P, and thereafter the conveyance resumes again. Paper sheet P is guided by conveyance path 140, paired pre-transfer rollers 143*a,* and guide plate 146 so that the toner image on photoreceptor 121 is transferred onto paper sheet P at transfer position $B_0$ employing transfer unit 124. Subsequently, charge elimination is carried out employing separation unit 125; paper sheet P is separated from the surface of the photoreceptor 121 and is conveyed to fixing unit 150, employing conveying unit 145.

Fixing unit 150 comprises fixing roller 151 as well as pressure roller 152. By passing paper sheet P between fixing roller 151 and pressure roller 152, heat as well as pressure is applied to melt-fix the toner. Paper sheet P, which has been subjected to fixing of its toner image, is ejected onto paper sheet ejecting tray 164.

Figure 2:
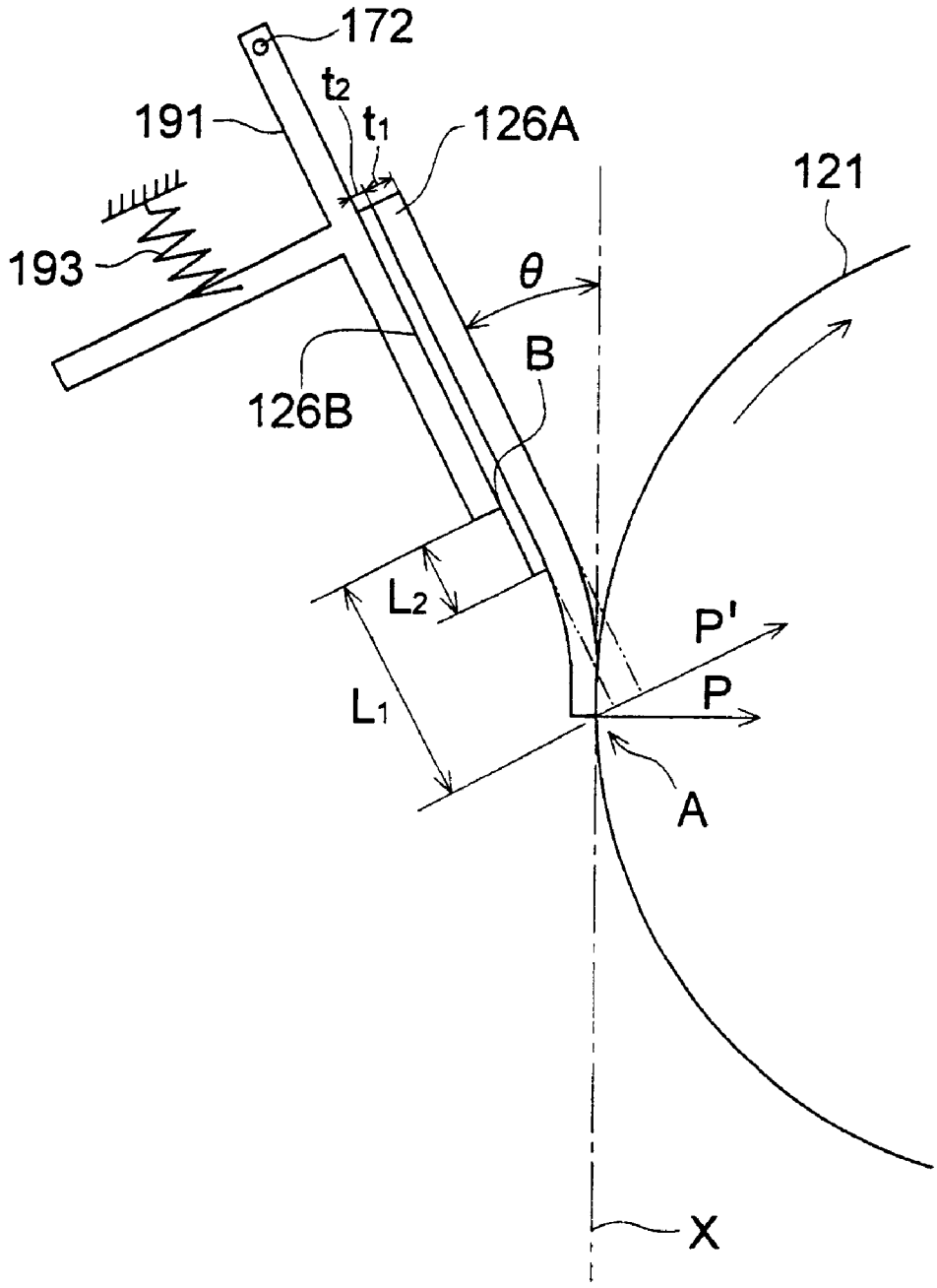
FIG. 2 is a view showing a configuration of a cleaning device employing the cleaning blade member of the present invention.

FIG. 2 is a schematic view of a cleaning device employing the cleaning blade member of the present invention.

In said cleaning device, cleaning blade member 126A and plastic member 126B are attached to support 191. Employed as a material of both said cleaning blade member and said plastic member is an elastic rubber material. Usable as materials are urethane rubber, silicone rubber, fluorine rubber, chloroprene rubber, butadiene rubber, and the like. Of these, urethane rubber is particularly preferred due to its excellent wear resistance compared to other rubber materials. For example, preferred are urethane rubber described in Japanese Patent Publication Open to Public Inspection No. 59-30574, which is obtained by allowing polycaprolactone ester to react with polyisocyanate followed by hardening, and the like.

The plastic member has a form of cleaning blade shape prepared by employing polymer material which can be formed in any shape by heating. The polymer material includes both of thermoplastic resin and thermosetting resin. A plastic sheet having specified physical properties obtained in the market can be employed for the plastic member by cutting into blade shape.

Preferable examples of polymer materials for the plastic member include a thermoplastic resin such as polyethylene terephthalate, polystyrene, polyacrylate, polyethylene, polypropylene, polyacrylate and styrene acrylate copolymer, a reinforced plastic such as glass fiber reinforced plastic and carbon fiber reinforced plastic, a cured thermosetting polymer material by three dimensionally crosslinking with low rubber elasticity.

In the present invention, when said plastic member 126B as well as said cleaning blade member 126A, is attached onto support member 191, said plastic member is arranged so as to be brought into close contact with the surface of the photoreceptor opposite to its surface which is brought into contact with said cleaning blade member, followed by being attached and maintained. At that time, the section, in which said cleaning blade member is brought into contact with said plastic member, possesses a mechanism which is capable of securely transferring vibration generated at said blade to said plastic member and allows said plastic member to absorb the vibration. By employing the positioning method as described above, it is possible to allow said plastic member effectively to absorb the vibration of said cleaning blade member, and thus it is possible to stabilize the vibration of said blade.

The optimal pressure contact conditions of the cleaning blade member onto the photoreceptor surface are determined depending on a delicate balance among various properties and exhibit a narrow range. Said conditions vary depending on the properties of the cleaning blade member such as thickness and the like. Thus the conditions are determined to high accuracy. However, the production of cleaning blade members is inevitably accompanied with slight fluctuation of their thickness. Therefore, it is difficult to maintain the optimal conditions at all times. Even though the optimal conditions are initially set, during use, the resultant conditions may deviate from the optimal range due to its narrow range. When combined specifically with an organic photosensitive layer employing a binder having a high molecular weight, the deviation from the optimal range causes blade curl as well as the residual toner.

Accordingly, it is necessary to take some measures to minimize the fluctuation of properties of the plastic member and the cleaning blade member, and the like. Even though the thickness of the cleaning blade member may fluctuate, it may be necessary to employ a setting method which does not affect the pressure contact force against the photoreceptor surface and the like.

In the present invention, the edge portion of a cleaning blade member is preferably brought into pressure contact with the photoreceptor surface in such a manner that load is applied to said edge in the opposite direction (the counter direction) to the rotation direction of the photoreceptor. As shown in FIG. 2, when the edge portion of the cleaning blade member is brought into pressure contact with the photoreceptor, a pressure contact area is preferably formed.

As shown in FIG. 2, the cleaning blade member and the plastic member of the present invention are positioned so that a level difference is provided between both edges. Further, the free length of the plastic member is shorter than that of the cleaning blade member. By employing such a configuration, without hindering the deformation (the deformation due to pressure contact with the photoreceptor) at the end portion of the cleaning blade member, and further by allowing the elastic body to absorb the vibration of the cleaning blade member, it is possible to stabilize the vibration of the cleaning blade member.

The ratio of the free length of the cleaning blade member to that of the plastic member satisfies Formula 1, wherein as shown in FIG. 2, L1 is the free length of the cleaning blade member and L2 is the free length of the plastic member. The free length as described herein means the length of each portion of the cleaning blade member and the plastic member which is not held by the support member. As shown in FIG. 2, the free length of the cleaning blade member L1 is the length from end B of support member 191 to the end of the cleaning blade member prior to its deformation and the free length of the plastic member L2 is the length from said end B to the end of the plastic member.

Formula 1: $0.1 < L2/L1 \leqq 0.9$

It has been discovered that the blade satisfies the ratio L2/L1 in said range, namely L2/L1 exceeds 0.1 and is not more than 0.9, without hindering the deformation (the deformation due to pressure contact against the photoreceptor) of the end portion of the cleaning blade member, and further by allowing the plastic member to absorb the vibration of the cleaning blade member, it is possible to realize uniform cleaning properties which result in neither blade curl nor residual toner, which is not removed. Further, in the present invention, the range is set more preferably between 0.3 and 0.7, and is set most preferably between 0.5 and 0.6. On the other hand, when L2/L1 is not more than 0.1, the toner tends not to be removed, while when L2/L1 is more than 0.9, blade curling tends to result.

The cleaning device of the present invention has the ratio of the thickness of the cleaning blade member to that of the plastic member satisfies Formula 2, wherein as shown in FIG. 2, $t_1$ is the thickness of the cleaning blade member and $t_2$ is the thickness of the plastic member:

Formula 2: $1/50 < t_2/t_1 < 1$

It has been discovered that by satisfying the ratio $t_2/t_1$ in said range, namely $t_2/t_1$ exceeds 1/50 and is less than 1, the cleaning blade member is held stably by the support member and any vibration of the cleaning blade member is absorbed by the plastic member, and thus it is possible to realize consistent cleaning properties which result in neither blade curl nor residual toner which is not removed. Further, the ratio of $t_2/t_1$ is preferably between 1/50 and 1/4. On the other hand, when $t_2/t_1$ is not more than 1/50, the toner tends not to be removed, while when $t_2/t_1$ is more than 1, blade curl tends to be caused.

In the present invention, contact load P and contact angle θ of said cleaning blade member against the photoreceptor are preferably 5 to 40 N/m and 5 to 35 degrees, respectively.

Said contact load P is a vector value in the normal direction of pressure contact force P', when blade 126A comes into contact with drum 121.

Further, said contact angle θ represents the angle of tangent X at contact point A of the photoreceptor to the blade prior to deformation. Numeral 172 is a screw which secures the support member, and 193 is a load spring.

Further, as shown in FIG. 2, free length L1 of said cleaning blade member represents the length from end B of support member 191 to the end of the cleaning blade member prior to deformation. Said free length L1 is preferably between 6 and 15 mm. The thickness of said cleaning blade member is preferably between 0.5 and 10 mm. Herein, as shown in FIG. 2, the thickness of the cleaning blade member and of the plastic member of the present invention is perpendicular to the contact surface of support 191.

The cleaning blade to be used in the invention is preferably a rubber elastic substance, and cleaning condition can be more effectively controlled by simultaneously controlling the property of the cleaning blade and that of the plastic member.

In the cleaning device according to the invention, the elastic modulus of the cleaning blade $D_1$ and that of the plastic member $D_2$ are set so as to satisfy the formula 3.

Formula 3

$$16 \leqq D_2/D_1 \leqq 2{,}800$$

It is found that the cleaning blade is stably supported by a supporting member and the vibration of the cleaning blade is absorbed by the plastic member so as to able to actualize a stable cleaning ability when the value of $D_2/D_1$ is set within the foregoing range of from 16 to 2,800. The value of $D_2/D_1$ is more preferably within the range of from 20 to 1,000. The slipping off of the toner through the blade tends to be occurred when the value of $D_2/D_1$ is less than 16, and the turning over of the blade tends to be occurred when the value of $D_2/D_1$ is more than 80,000.

In the invention, the elastic modulus is a tensile elastic modulus measured by the plastic tensile test method of JIS K 7113. The elastic modulus is determined from the ratio of the stress to the distortion corresponding to the stress within the tensile proportional range, when no straight portion is found in the tensile stress-distortion curve, the elastic modulus is determined by the gradient of tangential line at the deformation starting point of the test piece.

The elastic modulus is calculated according to the following formulas using the straight line portion of the tensile stress-distortion curve.

$D = \Delta\sigma/\Delta\epsilon D$: kgf/mm$^2$

D (elastic modulus): kgf/mm$^2$ $\Delta\sigma$: Difference of the stress per original sectional area between the two points on the straight line $\Delta\sigma$: Different of the distortion between the two points The cleaning device is designed so that the tensile strength H of the plastic member satisfies the formula 4.

Formula 4

$$1.4 \leqq H \leqq 35$$

It is found that the plastic member is stably supported by a supporting member and the vibration of the cleaning blade is absorbed by the plastic member so as to be able to actualize a stable cleaning ability when the value of H is set within the foregoing range of from 1.4 to 35. The value of H is more preferably within the range of from 3 to 9. The slipping off of the toner through the blade tends to be occurred when the value of H is less than 1.4, and the turning over of the blade tends to be occurred when the value of H is more than 35.

In the invention, the tensile strength H is a tensile strength measured by the plastic tensile test method of JIS K 7113. The value of H is calculated by dividing the maximum loading on the load-tensile curve by the minimum original sectional area of the test piece, and expressed by the following formulas.

$H=F/A$

H (tensile strength): $kgf/mm^2$

F: Load at the maximum loading: $kgf/mm^2$

A: The original minimum sectional area of the test piece ($mm^2$)

The cleaning device according to the invention is designed so that the bending strength M of the plastic member satisfies the formula 5.

Formula 5

$$0<M\leqq 41$$

It is found that the plastic member is stably supported by a supporting member and the vibration of the cleaning blade is absorbed by the plastic member so as to be able to actualize a stable cleaning ability when the value of M is set within the foregoing range of from more than 0 to 41. The value of M is more preferably within the range of from 0.95 to 39. The slipping off of the toner through the blade tends to be occurred when the value of M is 0, and the turning over of the blade tends to be occurred when the value of M is more than 41.

In the invention, the bending strength M is a bending strength measured by the hard plastic test method of JIS K 7203. The value of M is determined from the stress at the moment at which the load is reached to the maximum value, and the value M is expressed by the following formulas.

$M=3F_{max\cdot L}/2bh^2$

M: Bending strength ($kgf/mm^2$)

$F_{max}$: The maximum loading (kgf)

L: Distance between supporting points

B: Width of test piece

H: Height of test piece

The hardness of the cleaning blade member is preferably 55 to 90 at 25±5° C. in terms of JIS A "Hardness". When the hardness is not more than 55, the cleaning performance tends to be degraded, while when the hardness is no less than 90, the blade tends to be inverted. Further, the impact resilience of the cleaning blade member is preferably 25 to 80. When the impact resilience exceeds 80, the blade tends to be inverted. When the impact resilience is less than 25, cleaning performance is deteriorated. Young's modulus of the blade is preferably 294 to 588 $N/cm^2$.

Further, if desired, it is preferable that fluorine based lubricants are sprayed onto the end portion of the cleaning blade member which comes in contact with the photoreceptor, or further applied onto the whole said end portion along the width of the blade, which is prepared by dispersing fluorine based polymer and fluorine based resin powder into a fluorine based solvent.

The organic photoreceptors of the present invention will now be described.

In the present invention, the electrophotographic organic photoreceptors (hereinafter referred simply to as organic photoreceptors), as described herein, mean electrophotographic photoreceptors which are comprised of organic compounds having at least either a charge generating function or a charge transport function, which are essential to constitute electrophotographic photoreceptors, and include all electrophotographic organic photoreceptors known in the art such as photoreceptors comprised of organic charge generating materials or organic charge transport materials known in the art, photoreceptors in which a charge generating function as well as a charge transport function is exhibited, employing polymer complexes.

The organic photoreceptors employed in the present invention will now be described.

Electrically Conductive Support

Employed as electrically conductive supports may be those which are either in sheet or in cylindrical form. However, in order to make an image forming apparatuses small-sized, an electrically conductive cylindrical support is more preferred.

The electrically conductive cylindrical support as described in the present invention means a cylindrical support which is capable of endlessly forming images through its rotation, and the electrically conductive support is preferred which has a circularity of not more than 0.1 mm and a deviation of not more than 0.1 mm. When said circularity as well said deviation exceeds said limits, it becomes difficult to form consistently excellent images.

Employed as electrically conductive materials may be metal drums comprised of aluminum, nickel, and the like, plastic drums vacuum coated with aluminum, tin oxide, indium oxide, and the like, or paper-plastic drums coated with these kinds of electrically conductive materials. Said electrically conductive supports preferably exhibit a specific resistance of $10^3$ Ω cm or more.

The electrically conductive support employed in the present invention may have an anodized aluminum film on its surface, which is subjected to sealing. An anodized aluminum treatment is generally carried out in an acid bath such as, for example, chromic acid, sulfuric acid, oxalic acid, phosphoric acid, boric acid, sulfamic acid, and the like. Of these, anodic oxidation in sulfuric acid provides the most preferable results. The anodic oxidation in sulfuric acid is preferably carried out under conditions of a sulfuric acid concentration of 100 to 200 g/liter, an aluminum ion concentration of 1 to 10 g/liter, a solution temperature of about 20° C., and an applied voltage of 20 V. However, said conditions are not limited to these cited ones. Further, the average thickness of the resultant anodic oxidation film is generally not more than 20 μm, and is most preferably not more than 10 μm.

Interlayer

In the present invention, it is possible to provide an interlayer having a barrier function between the electrically conductive support and the photosensitive layer.

In the present invention, in order to improve adhesion between the electrically conductive support and said photosensitive layer, or to minimize charge injection from said support, it is possible to provide an interlayer (including a sublayer) between said support and said photosensitive layer. Listed as materials of said support are polyamide resins, vinyl chloride resins, vinyl acetate resins, and copolymer resins comprising at least two repeating units of these resins. Of these subbing resins, polyamide resins are preferable as the resins which are capable of minimizing an increase in residual potential accompanied under repeated use. Further, the thickness of the interlayer comprised of these resins is preferably between 0.01 and 0.5 μm.

Further, listed as an interlayer, which is most preferably employed, is that comprised of hardenable metal resins which are subjected to thermal hardening employing organic metal compounds such as silane coupling agents, titanium coupling agents, and the like. The thickness of the interlayer comprised of said hardenable metal resins is preferably between 0.1 and 2 μm.

Photosensitive Layer

The photosensitive layer configuration of the photoreceptor of the present invention may be one comprised of a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration in which the functions are separated, it is possible to control an increase in residual potential, accompanied under repeated use at a low level, and to readily control the other electrophotographic properties to desired values. A negatively charged photoreceptor is preferably composed in such a manner that applied onto the interlayer is the charge generating layer (CGL), onto which the charge transport layer is applied. On the other hand, a positively charge photoreceptor is composed so that the order of the layers employed in the negatively charged photoreceptor is reversed. The most preferable photosensitive layer configuration is the negatively charged photoreceptor configuration having said function separation structure.

The photosensitive layer configuration of a function separated negatively charged photoreceptor is now described.

Charge Generating Layer

The charge generating layer comprises charge generating materials (CGM). As to other materials, if desired, binder resins and other additives may be incorporated.

Employed as charge generating materials may be those commonly known in the art. For example, employed may be phthalocyanine pigments, azo pigments, perylene pigments, azulenium pigments, and the like. Of these, CGMs, which are capable of minimizing the increase in residual potential, accompanied under repeated use, are those which comprise a three-dimensional electrical potential structure capable of taking stable agglomerated structure between a plurality of molecules. Specifically listed are CGMs of phthalocyanine pigments and perylene pigments having a specific crystal structure. For instance, titanyl phthalocyanine having a maximum peak at 27.2° of Bragg angle 2θ with respect to a Cu-Kα line, benzimidazole perylene having a maximum peak at 12.4° of said Bragg 2θ, and the like, result in minimum degradation under repeated use and can minimize the increase in residual potential.

When in the charge generating layer, binders are employed as the dispersion media of CGM, employed as binders may be any of the resins known in the art. Listed as the most preferable resins are formal resins, butyral resins, silicone resins, silicone modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As to other materials, if desired, also incorporated may be additives such as antioxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV from a combined CGM.

The ionization potential of CGM and CTM is measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors, such as poly-N-vinylcarbazole.

The most preferable as CTL binders are polycarbonate resins. Polycarbonate resins are most preferred because the dispersibility of CTM as well as electrophotographic properties is improved. In the case of the photoreceptor in which the charge transport layer is employed as the surface layer, polycarbonates which exhibit high mechanical wear resistance are preferred and polycarbonates having an average molecular weight of at least 40,000 are also preferable. The ratio of binder resins to charge transport materials is preferably between 10 and 200 weight parts per 100 weight parts of the binder resins. Further, the thickness of the charge transport layer is preferably between 10 and 40 μm.

Protective Layer

Provided as protective layers of a photoreceptor may be various types of resinous layers. Specifically, it is possible to obtain the photoreceptor having high mechanical strength of the present invention by providing a cross linked resinous layer.

Listed as solvents or dispersion media which are employed to form layers such as photosensitive layers, protective layers, and the like, are n-butylamine, diethylamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dicholorethane, 1,2-dichloropropane, 1,1,2-trichloroethane, 1,1,1-trichloroethane, trichloroethylene, tetrachloroethane, tetrahydrofuran, dioxysolan, dioxane, methanol, ethanol, butanol, isopropanol, ethyl acetate, butyl acetate, dimethyl sulfoxide, methyl cellosolve, and the like. However, the present invention is not limited to these examples, and also preferably employed are dichloromethane, 1,2-dicholorethane, methyl ethyl ketone, and the like. Further, these solvents may be employed individually or in combination as a solvent mixture of two or more types.

Employed as coating methods to produce electrophotographic organic photoreceptors of the present invention are dip coating, spray coating, circular amount regulating type coating, and the like. When an upper layer is applied onto the photosensitive layer, preferably employed coating methods such as spray coating or circular amount-regulating type coating (including a circular slide hopper type as its representative example) and the like so that the dissolution of the lower layer is minimized and uniform coating is achieved. Incidentally, the protective layer of the present invention is most preferably applied employing said circular amount-regulating type coating method. Said circular amount-regulating type coating is detailed in, for example, Japanese Patent Publication Open to Public Inspection No. 58-189061.

Described next will be the toner which is employed in the present invention.

Preferred as the toner of the present invention is a polymerized toner in which the size distribution of individual toner particles as well as their shape is relatively uniform. The polymerized toner as described herein means a toner obtained in such a manner that binder resins for the toner as well the shape of toner particles are formed by polymerization of monomers as the raw materials of the binder resins followed by chemical treatment. More specifically, said polymerized toner means the toner which is obtained by polymerization such as suspension polymerization, emulsion polymerization and the like, if desired, followed by a fusing process among particles which is carried out after said polymerization.

Preferred as the polymerized toner which is employed in the cleaning device employing the cleaning blade member of the present invention is one having a specific shape of toner particles. The polymerized toner, which may preferably be employed in the present invention, will be described below.

The polymerized toner, which is preferably employed in the present invention, has a number ratio of toner particles having a shape coefficient of 1.2 to 1.6 and is at least 65 percent, and further the variation coefficient of said shape coefficient is not more than 16 percent. In the present invention, it has been discovered that even though such a polymerized toner is employed, it is possible to stabilize the vibration of the cleaning blade member, and excellent cleaning performance is exhibited.

Further, the stability of the vibration of the cleaning blade member is dependent on the diameter of toner particles. As the diameter of particles decrease, adhesion of toner particles to the image bearing body increases. As a result, the resultant vibration tends to become excessive, and toner particles are more likely not to be removed by the cleaning blade member. On the other hand, toner particles, having a larger diameter, are more readily removed by the cleaning blade member. However, problems occur in which image quality such as resolution, and the like, is degraded.

Investigation was carried out based on the aforementioned viewpoints. As a result, it has been discovered that by employing a toner having a variation coefficient of the toner shape coefficient of not more than 16 percent, as well as having a number variation coefficient in the toner number size distribution of not more than 27 percent, high image quality, which is exhibited by excellent cleaning properties, as well as excellent fine line reproduction, can be obtained over an extended period of time.

Further, by employing a toner in which the number ratio of toner particles, having no corners, is set at 50 percent and the number variation coefficient in the number size distribution is adjusted to not more than 27 percent, it is possible to obtain high image quality over an extended time of period, which exhibits excellent cleaning properties, as well as excellent fine line reproduction.

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by Nihon Denshi Co. At that time, 100 toner particles were employed and the shape coefficient of the present invention was obtained employing the aforementioned calculation formula.

The polymerized toner of the present invention is that the number ratio of toner particles in the range of said shape coefficient of 1.2 to 1.6 is preferably at least 65 percent and is more preferably at least 70 percent.

By adjusting the number ratio of toner particles in the range of a shape coefficient of 1.2 to 1.6 to at least 65 percent, the triboelectrical properties become more uniform on the developer conveying member resulting in no accumulation of excessively charged toner particles, and said toner particles are more readily replaced from the surface of said developer conveying member to minimize the generation of problems such as development ghost and the like. Further, the toner particles tend not to be crushed, resulting in decreased staining on the charge providing member and chargeability of the toner is stabilized.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The variation coefficient of the polymerized toner, which is preferably employed in the present invention, is calculated using the formula described below:

Variation coefficient=$(S/K)\times 100$ (in percent) wherein S represents the standard deviation of the shape coefficient of 100 toner particles and K represents the average of said shape coefficient.

Said variation coefficient of the shape coefficient is generally not more than 16 percent, and is preferably not more than 14 percent. By adjusting said variation coefficient of the shape coefficient to not more than 16 percent, voids in the transferred toner layer decrease to improve fixability and to minimize the formation of offsetting. Further, the resultant charge amount-distribution narrows to improve image quality.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

Number variation coefficient=$(S/D_n)\times 100$ (in percent) wherein S represents the standard deviation in the number particle size distribution and $D_n$ represents the number average particle diameter (in $\mu$m).

The number variation coefficient of the toner of the present invention is not more than 27 percent, and is preferably not more than 25 percent. By adjusting the number variation coefficient to not more than 27 percent, voids of the transferred toner layer decrease to improve fixability and to minimize the formation of offsetting. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

The toner particles of the present invention, which substantially have no corners, as described herein, mean those having no projection to which charges are concentrated or which tend to be worn down by stress. Namely, as shown in FIG. 13(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 13(*b*) and 13(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Further, decreased are toner particles which are readily worn and broken, as well as those which have a portion at which charges are concentrated. Thus, since the charge amount distribution is narrowed, it is possible to stabilize chargeability, resulting in excellent image quality over an extended period of time.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Of methods to control the shape coefficient, the polymerized toner method is preferable since it is simple as well as convenient as a toner production method, the surface uniformity is excellent compared to pulverized toner, and the like.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

Incidentally, the water based medium as described in the present invention means one in which at least 50 percent, by weight of water, is incorporated.

Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating . . . After completing the reaction, the dispersion stabilizers are removed, filtered, washed, and subsequently dried. In this manner, the toner of the present invention is prepared.

Further, listed as a method for preparing said toner may be one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 1,000,000, which can be measured employing gel permeation chromatography. Further preferred as resins are those having a molecular weight distribution of Mw/Mn of 1.5 to 100, and is most preferably between 1.8 and 70.

Employed coagulants are not particularly limited, but those selected from metal salts are more suitable. Specifically, listed as univalent metal salts are salts of alkaline metals such as, for example, sodium, potassium, lithium, and the like; listed as bivalent metal salts are salts of alkali earth metals such as, for example, calcium, magnesium, and salts of manganese, copper, and the like; and listed as trivalent metal salts are salts of iron, aluminum, and the like. Listed as specific salts may be sodium chloride, potassium chloride, lithium chloride, calcium chloride, zinc chloride, copper sulfate, magnesium sulfate, manganese sulfate, and the like. These may also be employed in combination.

These coagulants are preferably added in an amount higher than the critical coagulation concentration. The critical coagulation concentration as described herein means an index regarding the stability of water based dispersion and concentration at which coagulation occurs through the addition of coagulants. Said critical coagulation concentration markedly varies depending on emulsified components as well as the dispersing agents themselves. Said critical coagulation concentration is described in, for example, Seizo Okamura, et al., "Kobunshi Kagaku (Polymer Chemistry) 17", 601 (1960) edited by Kobunshi Gakkai, and others, based on said publication, it is possible to obtain detailed critical coagulation concentration. Further, as another method, a specified salt is added to a targeted particle dispersion while varying the concentration of said salt; the $\xi$ potential of the resultant dispersion is measured, and the critical coagulation concentration is also obtained as the concentration at which said $\xi$ potential varies.

The acceptable amount of the coagulating agents of the present invention is an amount of more than the critical coagulation concentration. However, said added amount is preferably at least 1.2 times as much as the critical coagulation concentration, and is more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like.

Employed as charge control agents may also be various types of those which are can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of said charge control agents as well as said fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention. Reaction apparatuses, which are preferably employed in the present invention, will now be described.

Figure 3:
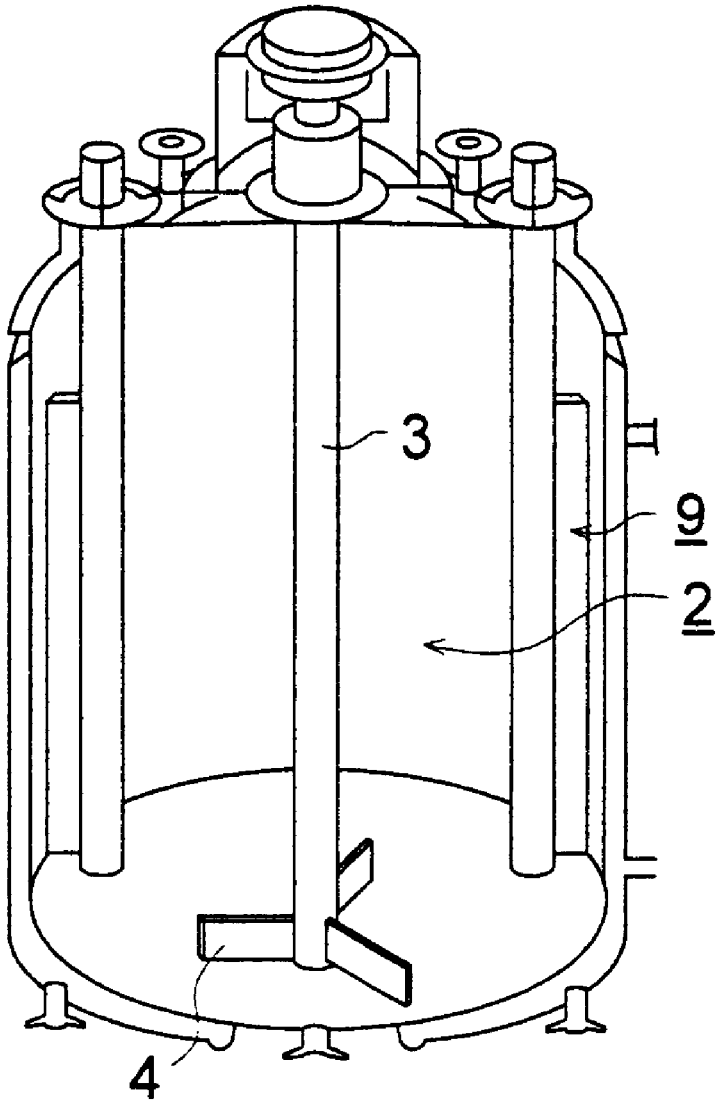
FIG. 3 is a view explaining a reaction apparatus having one level configuration of the stirring blade.

FIG. 3 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow inducing member.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 3, the medium in stirring tank 2 flows only from the bottom part to the upper part along the wall. Due to that, a conventional turbulent flow is commonly formed and stirring efficiency is enhanced by installing turbulent flow forming member 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 4:
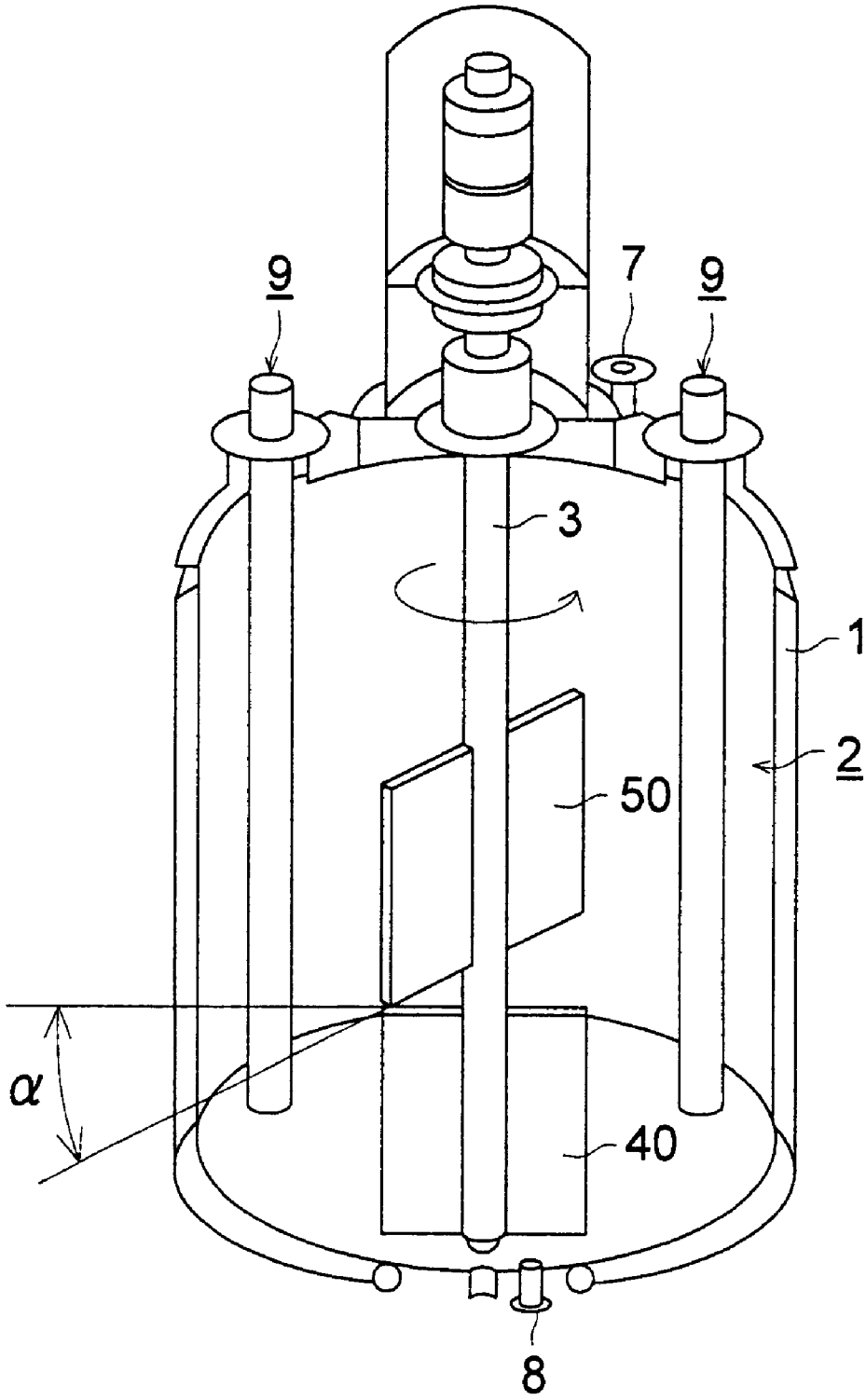
FIG. 4 is a perspective view showing one example of a reaction apparatus which is provided with preferably employable stirring blades.
Figure 5:
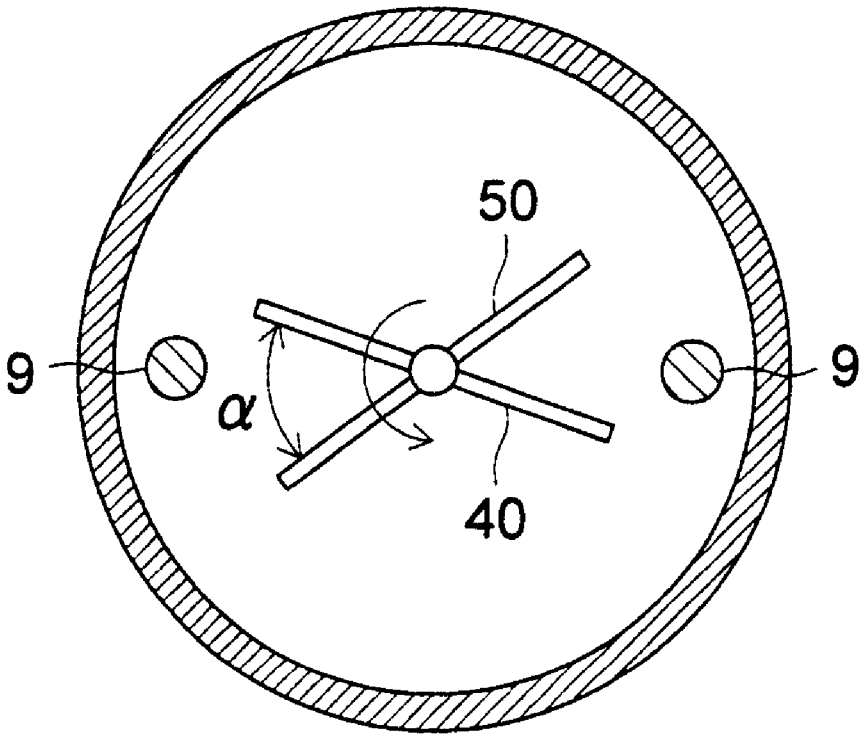
FIG. 5 is a cross-sectional view of the reaction apparatus shown in FIG. 4.

FIGS. 4 and 5 are a perspective view and a cross-sectional view, of the reaction apparatus described above, respectively. In the reaction apparatus illustrated in FIGS. 4 and 5, rotating shaft 3 is installed vertically at the center in vertical type cylindrical stirring tank 2 of which exterior circumference is equipped with a heat exchange jacket, and said rotating shaft 3 is provided with lower level stirring blades 40 installed near the bottom surface of said stirring tank 40 and upper level stirring blade 50. The upper level stirring blades 50 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by said stirring blades 50 themselves, as a whole, accelerating the flow. As a result, it is further assumed that since a flow area is formed which has large shearing stress in the turbulent flow, it is possible to control the shape of the resultant toner.

Incidentally, in FIGS. 4 and 5, arrows show the rotation direction, reference numeral 7 is upper material charging inlet, 8 is a lower material charging inlet, and 9 is a turbulent flow forming member which makes stirring more effective.

Figure 12:
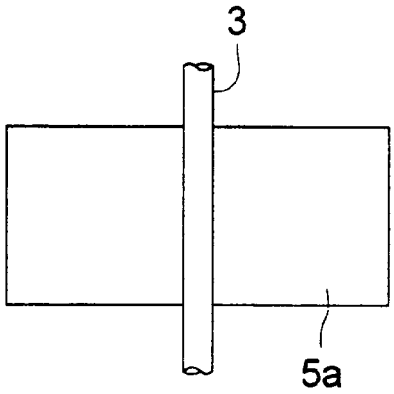
FIG. 12 is a schematic view showing a specific example of the shape of a stirring blade.
Figure 12:
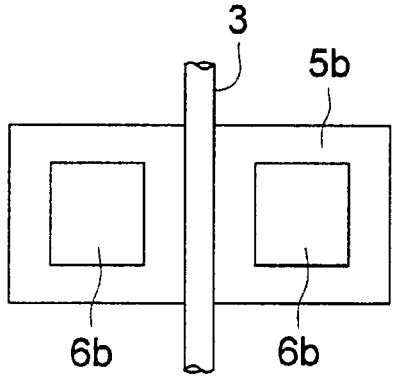
Figure 12:
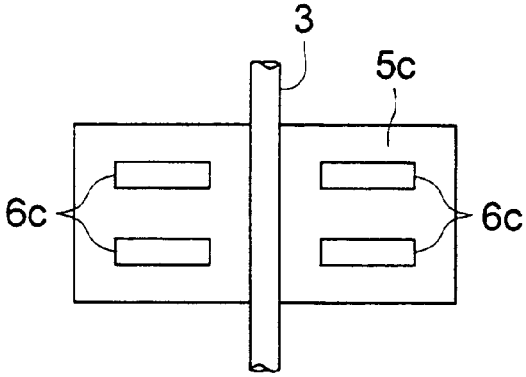
Figure 12:
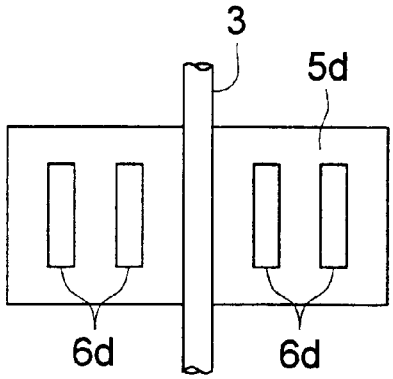

Herein, the shape of the stirring blades is not particularly limited, but employed may be those which are in square plate shape, blades in which a part of them is cut off, blades having at least one opening in the central area, having a so-called slit, and the like. FIG. 12 describes specific examples of the shape of said blades. Stirring blade 5*a* shown in FIG. 12(*a*) has no central opening; stirring blade 5*b* shown in FIG. 12(*b*) has large central opening areas 6*b;* stirring blade 5*c* shown in FIG. 12(*c*) has rectangular openings 6*c* (slits); and stirring blade 5*d* shown in FIG. 12(*d*) has oblong openings 6*d* shown in FIG. 12(*d*). Further, when stirring blades of a three-level configuration are installed, openings which are formed at the upper level stirring blade and the openings which are installed in the lower level may be different or the same.

FIGS. 6 through 10 each show a perspective view of a specific example of a reaction apparatus equipped with stirring blades which may be preferably employed. In FIGS. 6 through 10, reference numeral 1 is a heat exchange jacket, 2 is a stirring tank, 3 is a rotation shaft, 7 is an upper material charging inlet, 8 is a lower material charging inlet, and 9 is a turbulent flow forming member.

Figure 6:
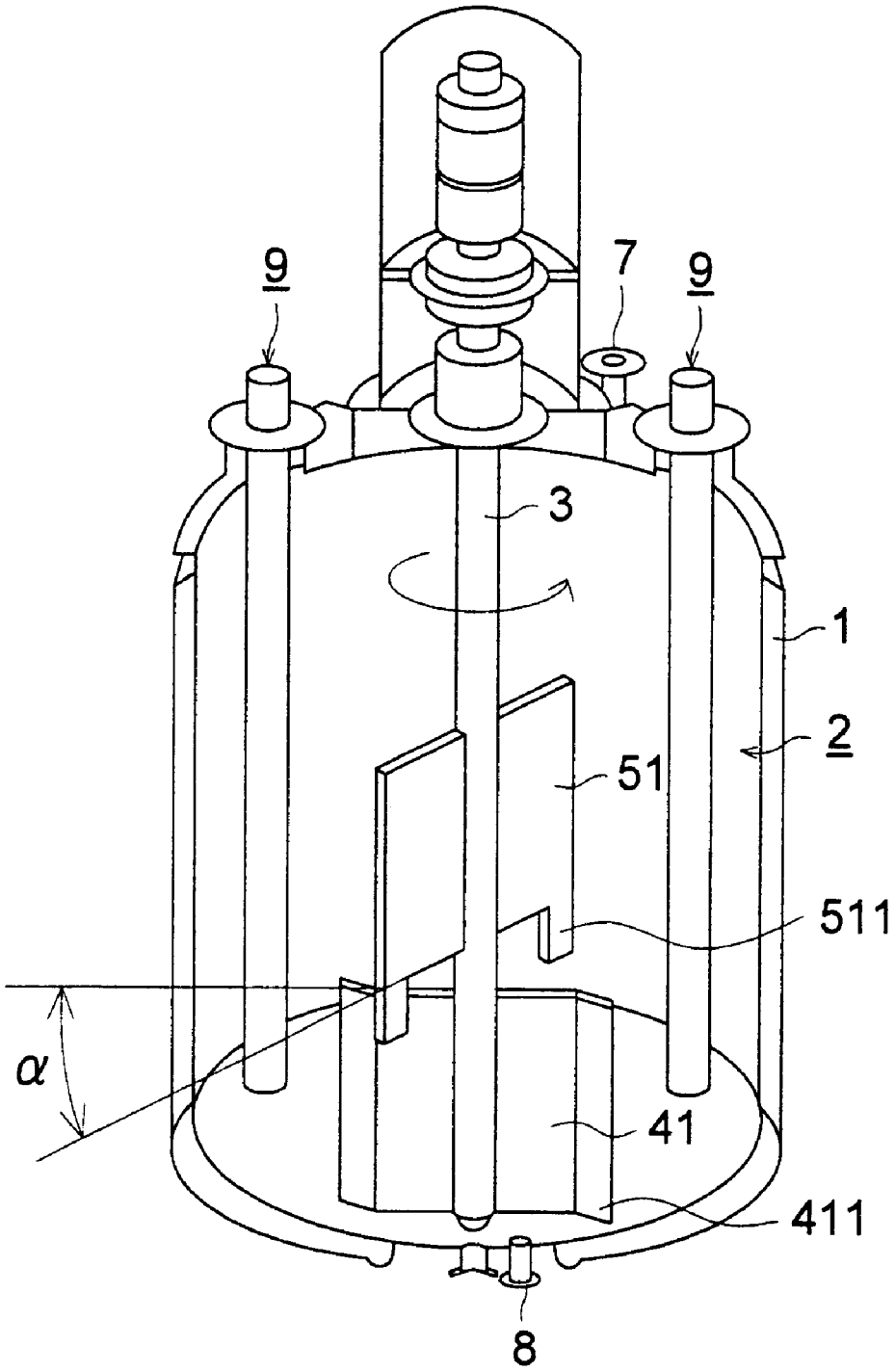
FIG. 6 is a perspective view showing a specific example of a reaction apparatus provided with the preferably employable stirring blades.

In the reaction apparatus shown in FIG. 6, folded parts 411 are formed on stirring blade 42 and fins 511 (projections) are formed on stirring blade 51.

Further, when said folded sections are formed, the folded angle is preferably between 5 and 45 degrees.

Figure 7:
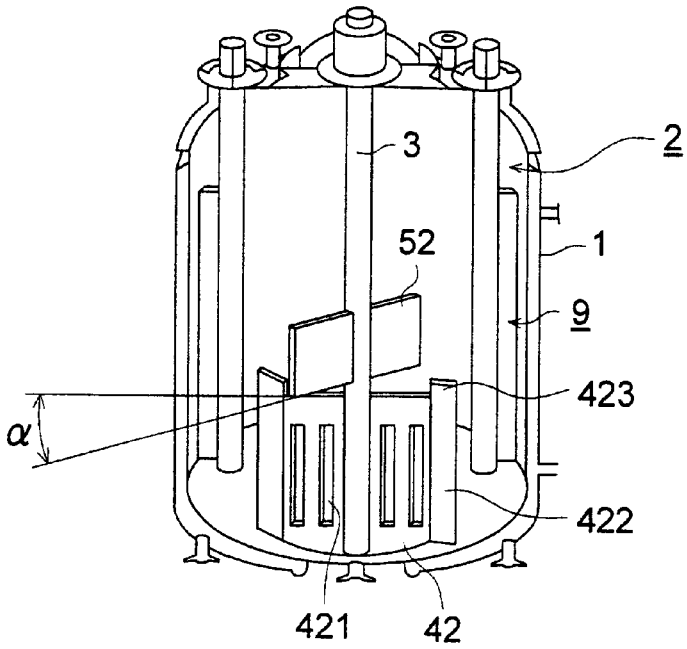
FIG. 7 is a perspective view showing a specific example of a reaction apparatus provided with the preferably employable stirring blades.

In stirring blade 42 which constitutes the reaction apparatus shown in FIG. 7, slits 142, folded sections 422, and fins 423 are formed simultaneously.

Further, stirring blade 52, which constitute part of the reaction apparatus, has the same shape as stirring blade 50 which constitutes part of the reaction apparatus shown in FIG. 4.

Figure 8:
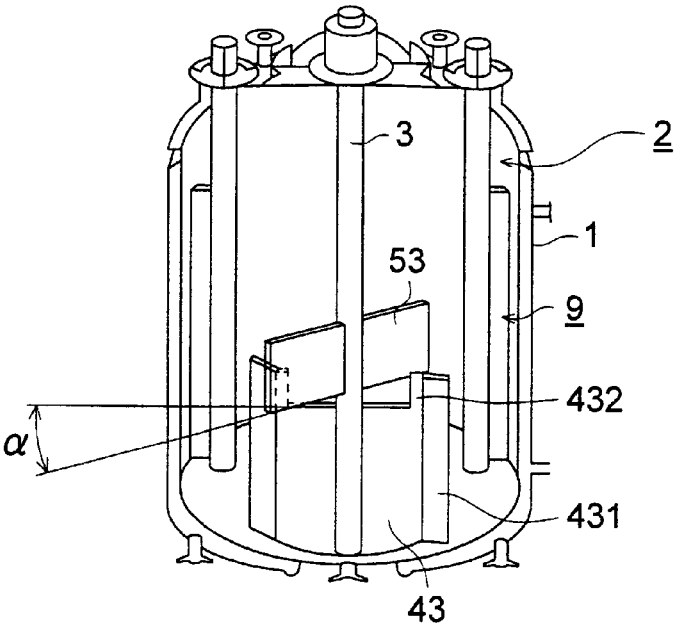
FIG. 8 is a perspective view showing a specific example of a reaction apparatus provided with the preferably employable stirring blades.

In stirring blade 43 which constitutes part of the reaction apparatus shown in FIG. 8, folded section 431 as well as fin 432 is formed.

Further, stirring blade 53, which constitutes part of said reaction apparatus, has the same shape as stirring blade 50 which constitutes part of the reaction apparatus shown in FIG. 4.

Figure 9:
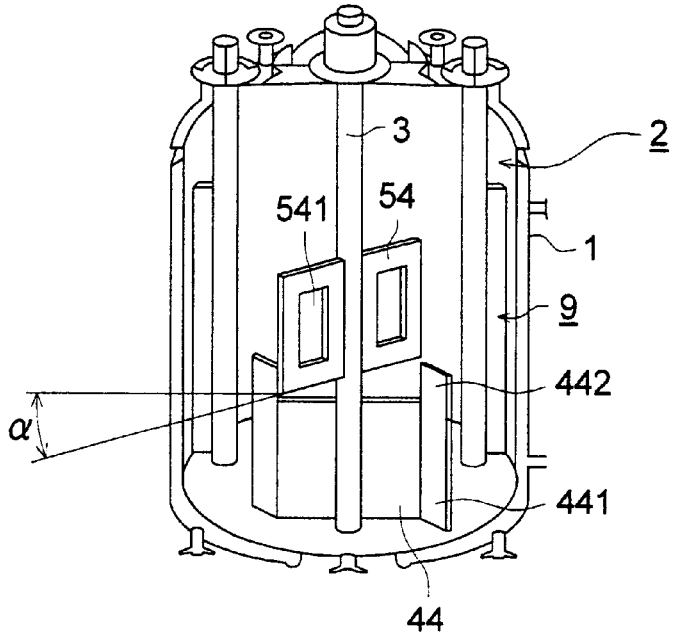
FIG. 9 is a perspective view showing a specific example of a reaction apparatus provided with the preferably employable stirring blades.

In stirring blade 44 which constitutes part of the reaction apparatus shown in FIG. 9, folded section 441 as well as fin 442 is formed.

Further, in the stirring blade 54 which constitutes part of said reaction apparatus, openings 541 are formed in the center of the blade.

Figure 10:
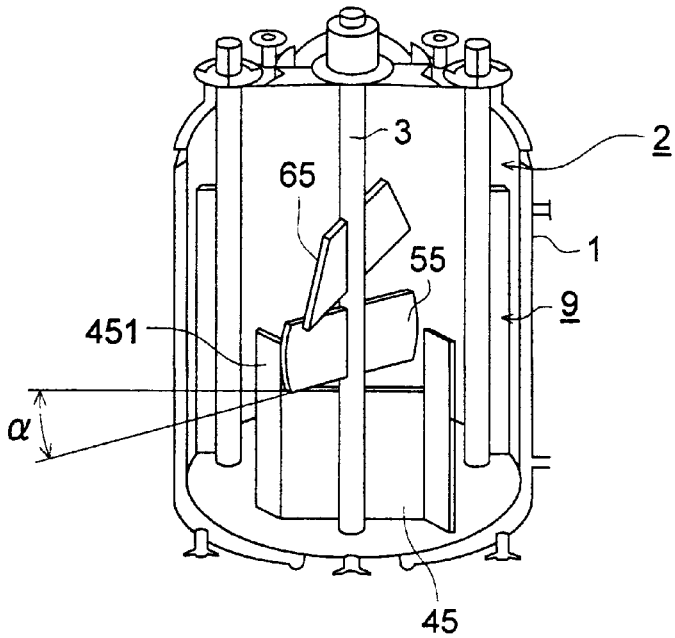
FIG. 10 is a perspective view showing a specific example of a reaction apparatus provided with the preferably employable stirring blades.

In the reaction apparatus shown in FIG. 10, provided are stirring blades at three-level comprised of stirring blade 45 (at the lower level), stirring blade 55 (at the middle level), and stirring blades 65 at the top are provided.

Stirring blades having such folded sections, stirring blades which have upward and downward projections (fins), all generate an effective turbulent flow.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 11:
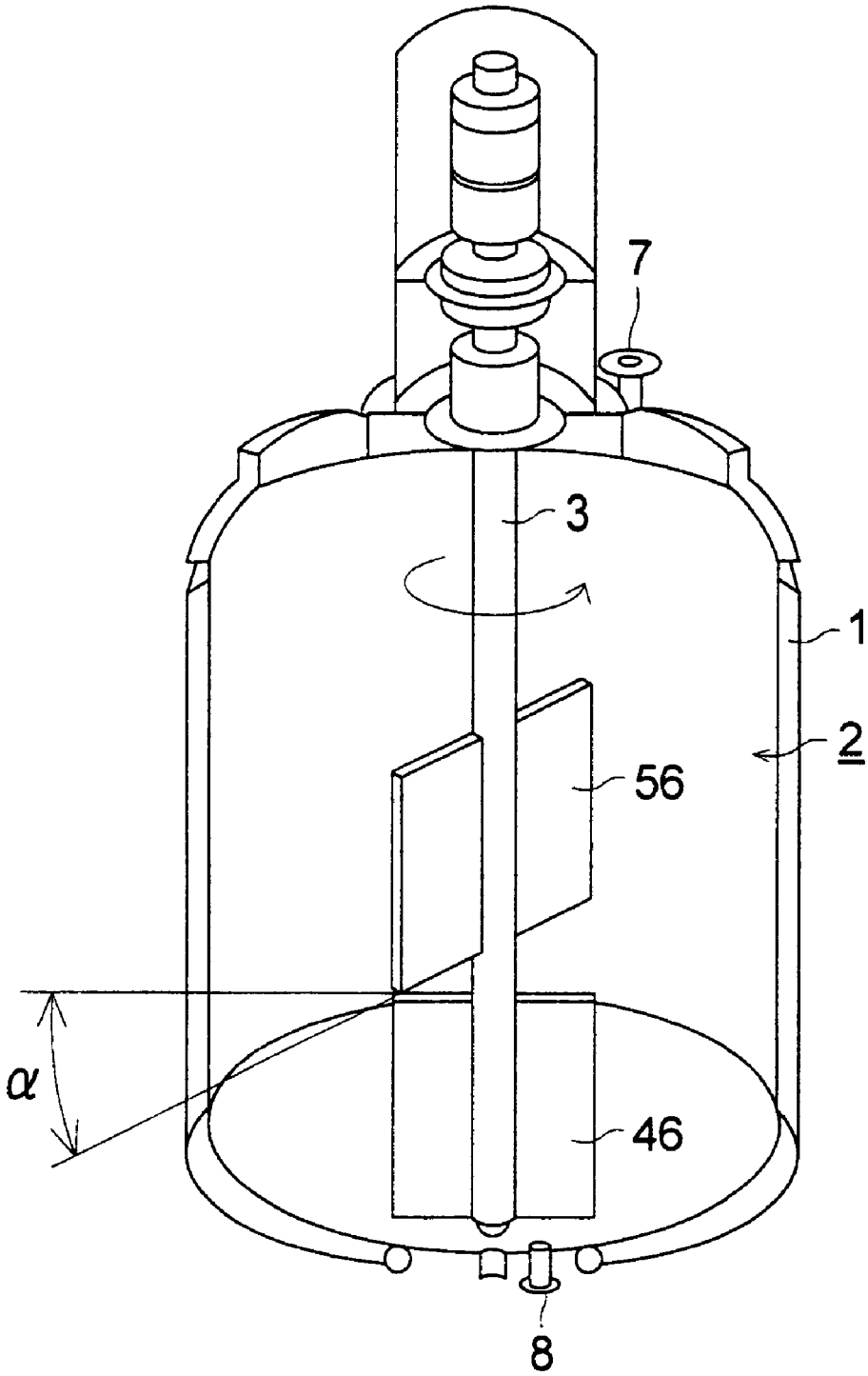
FIG. 11 is a perspective view showing one example of a reaction apparatus employed so that a laminar flow forms.

Still further, FIG. 11 shows one example of a reaction apparatus employed when a laminar flow is formed in the suspension polymerization method. Said reaction apparatus is characterized in that no turbulent flow forming member (obstacles such as a baffle plate and the like) is provided.

Stirring blade 46, as well as stirring blade 56, has the same shape as well as the crossed axis angle of stirring blade 40, as well as stirring blade 50 which constitutes part of the reaction apparatus shown in FIG. 4. In FIG. 11, reference numeral 1 is a heat exchange jacket, 2 is a stirring tank, 3 is a rotation shaft, 7 is an upper material charging inlet, and 8 is a lower material charging inlet.

Incidentally, apparatuses, which are employed to form a laminar flow, are not limited to ones shown in FIG. 11.

Further, the shape of stirring blades, which constitute part of said reaction apparatuses, is not particularly limited as long as they do not form a turbulent flow, but rectangular plates and the like which are formed with a continuous plane are preferable and may have a curved plane.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

Namely, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed, and for example, it is possible to employ the apparatus shown in FIG. 11. Said apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle $\alpha$ in advance in the rotation direction with respect to the lower stirring blade.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 12(*a*), which are formed of a continuous plane are preferable, and those having a curved plane may also be employed.

Further, the toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by L1 ml, the degree of hydrophobicity is calculated based on the formula described below:

Degree of hydrophobicity=[a/(a+50)]×100

The added amount of said external additives is generally between 0.1 and 5.0 percent by weight with respect to the toner, and is preferably between 0.5 and 4.0 percent. Further, external additives may be employed in combinations of various types.

Employed as external additives which are used in the present invention may be fatty acid metal salts. Cited as fatty acids and salts thereof are long chain fatty acids such as undecylic acid, lauric acid, tridecyl acid, dodecyl acid, myristic acid, palmitic acid, pentadecylic acid, stearic acid, heptadecylic acid, arachic acid, montanic acid, oleic acid, linoleic acid, arachidonic acid, as well as their salts of metals such as zinc, iron, magnesium, aluminum, calcium, sodium, lithium and the like. In the present invention, zinc stearate is particularly preferable.

A double component developer is prepared by mixing a toner with a carrier. The concentration of the toner in the developer is to be between 2 and 10 percent by weight, and the resultant developer is employed.

Development methods according to the present invention are not particularly limited. A contact development method may be employed in which development is carried out in such a manner that the photoreceptor surface comes into contact with the developer layer, and a non-contact development method may also by employed in which the photoreceptor surface and the developer layer are maintained in a non-contact state, and development is carried out by allowing the toner jump in the space between the photoreceptor surface and the developer layer, employing means such as an alternating electrical field and the like.

EXAMPLES

The present invention will now be detailed with reference to examples. Incidentally, "parts" in the description means "parts by weight", unless otherwise specified.

The photoreceptors, which are employed in the present invention, are prepared as described below.

Preparation of Photoreceptor PI

Placed into a solvent comprised of 90 ml of methanol and 100 ml of 1-butanol were 30 g of polyamide resin Amiran CM-8000 (manufactured by Toray), and were dissolved at 30° C. The resultant solution was applied onto a 360 mm long cylindrical aluminum electrically conductive support. Thus a 0.5 mm thick interlayer was formed.

Subsequently, 10 g of silicone resin KR-5240 (manufactured by Shin-Etsu Kagaku Co.) were dissolved in 1,000 ml of t-butyl acetate. The resultant solution was blended with 10 g of Y-TiOPc (described in FIG. 1 of Japanese Patent Publication Open to Public Inspection No. 64-17066), and the resultant mixture was dispersed for 20 hours employing a sand mill. Thus a charge generating layer coating composition was obtained. Said composition was applied onto said interlayer, and thus a 0.3 $\mu$m thick charge generating layer was formed.

Next, 150 g of CMT (T-1 N-(4-methylphenyl)-N-{4-(β-phenylstyryl)phenyl}-p-toluidine) and 200 g of polycarbonate resin, TS-2050, having a viscosity average molecular weight of 50,000 (manufactured by Teijin Kagaku Co., Ltd.) were dissolved in 1,000 ml of 1,2-dichloroethane and a charge transport layer coating composition was thus prepared. After applying said composition onto said charge generating layer employing a circular slide hopper, the coated layer was dried at 100° C. for one hour, and a 22 $\mu$m thick charge transport layer was formed. As described above, Photoreceptor P1 was obtained, which was comprised of the interlayer, the charge generating layer, and the charge transport layer.

Preparation of Photoreceptor P2

Applied onto said charge transport layer of the photoreceptor sample (P1), which was obtained in the production example of Photoreceptor P1, was a coating composition prepared by dissolving 30 g of CTM (T-1) and 50 g of polycarbonate resin, Ubiron Z-800, having a viscosity average molecular weight of 80,000 (manufactured by Mitsubishi Gas Kagaku Co.) in 1,000 ml of 2-dichloroethane, employing a circular slide hopper. Thereafter, the coated layer was dried at 100° C. for one hour to form a 5 μm thick overcoat layer. Thus Photoreceptor P2 was obtained.

Preparation of Photoreceptor P3

On the charge generating layer of the production example of Photoreceptor P1, a charge transport layer coating composition was obtained by dissolving 150 g of CTM (T-1) and 200 g of polycarbonate resin, Ubiron Z-800, having a viscosity average molecular weight of 80,000 (manufactured by Mitsubishi Gas Kagaku Co.) in 1,000 ml of 2-dichloroethane. After said composition was applied onto each of said charge generating layers, the coated layer was dried at 100° C. for one hour to form a 22 μm thick charge transport layer. As described above, Photoreceptor P3 was obtained which was comprised of the interlayer, the charge generating layer, and the charge transport layer.

Toner employed in the present invention was prepared as described below.

Production of Toners T1 and T2 (Example of Emulsion Polymerization Method)

Added to 10.0 liters of pure water was 0.90 kg of sodium dodecyl sulfate, which was dissolved while stirring. Gradually added to the resultant solution were 1.20 kg of Regal 330R (carbon black, manufactured by Cabot Co.), and stirred well for one hour. Thereafter, the resultant mixture was continuously dispersed for 20 hours, employing a sand grinder (a medium type homogenizer). The resultant dispersion was designated as "Colored Dispersion 1". Further, a solution comprised of 0.055 kg of sodium dodecylbenzenesulfonate and 4.0 liters of deionized water was designated as "Anionic Surface Active Agent Solution A".

A solution comprised of 0.014 kg of nonyl phenyl polyethylene oxide 10-mole addition product and 4.0 liters of deionized water was designated as "Nonionic Surface Active Solution B". A solution prepared by dissolving 223.8 g of potassium persulfate in 12.0 liters of deionized water was designated as "Initiator Solution C".

Placed into a 100-liter GL (glass lining) reaction tank, fitted with a thermal sensor, a cooling pipe, and a nitrogen gas introducing device, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution A", and all of "Nonionic Surface Active Agent B", and the resultant mixture was stirred. Subsequently, 44.0 liters of deionized water were added.

When the mixture was heated to 75° C., all of "Initiator Solution C" was added dropwise. Thereafter, while maintaining the temperature of the mixture at 75±1° C., 12.1 kg of styrene, 2.88 kg of n-butyl acrylate, 1.04 kg of methacrylic acid, and 548 g of t-dodecylmercaptan were added dropwise. After finishing dropwise addition, the mixture was heated to 80±1° C. and stirred for 6 hours while being heated. Subsequently the resultant mixture was cooled to not more than 40° C., and stirring was terminated. Said mixture was filtered employing a pole filter and the resultant filtrate was designated as "Latex (1)-A".

Incidentally, the glass transition temperature of resinous particles in Latex (1)-A was 57° C., and the softening point of the same was 121° C. The molecular weight distribution of the same exhibited parameters such as a weight average molecular weight of 12,700 and a weight average particle diameter of 120 nm.

Further, a solution, prepared by dissolving 0.055 kg of sodium dodecylbenzene sulfonate in 4.0 liters of deionized water, was designated as "Anionic Surface Active Agent Solution D". Still further, a solution prepared by dissolving 0.014 kg of nonyl phenol polyethylene oxide 10-mole added product in 4.0 liters of deionized water was designated as "Nonionic Surface Active Agent Solution E".

A solution, prepared by dissolving 200.7 g of potassium persulfate (manufactured by Kanto Kagaku Co.) in 12.0 liters of deionized water, was designated as "Initiator Solution F".

Placed into a 100-liter GL reaction tank, fitted with a thermal sensor, a cooling pipe, a nitrogen gas introducing device, and a comb-shaped baffle, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution D", and all of "Nonionic Surface Active Agent E", and the resultant mixture was stirred. Subsequently, 44.0 liters of deionized water were added. When the mixture was heated to 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. Thereafter, while maintaining the temperature of the mixture at 72±2° C., stirring was carried out for 6 hours while being heated. The temperature was further raised to 80±2° C., and stirring was carried out for 12 hours while being heated. The resultant solution was cooled to not more than 40° C., and stirring was terminated. Filtration was carried out employing a pole filter, and the resultant filtrate was designated as "Latex (1)-B.

Incidentally, the glass transition temperature of resinous particles in Latex (1)-B was 58° C., and the softening point of the same was 132° C. The molecular weight distribution of the same exhibited parameters such as a weight average molecular weight of 245,000 and a weight average particle diameter of 110 nm.

A solution, prepared by dissolving 5.36 kg of sodium chloride as the salting-out agent in 20.0 liters of deionized water, was designated as "Sodium Chloride Solution G".

A solution, prepared by dissolving 1.00 g of a fluorine based nonionic surface active agent in 1.00 liter of deionized water, was designated as "Nonionic Surface Active Agent Solution H".

Placed into a 100-liter SUS reaction tank, fitted with a thermal sensor, a cooling pipe, a nitrogen gas introducing device, and a particle diameter and shape monitoring device (a reaction apparatus which is shown in FIG. 11 in which the crossed axis angle a is set at 20 degrees) were 20.0 kg of Latex (1)-A and 5.2 kg of Latex (1)-B prepared as described above, 0.4 kg of colorant dispersion, and 20.0 kg of deionized water and the resultant mixture was stirred. Subsequently, said mixture was heated at 40° C., which was added to Sodium Chloride Solution G, 6.00 kg of isopropanol (manufactured by Kanto Kagaku Co.) and Nonionic Surface Active Agent Solution H in said order. Thereafter, the mixture was set aside for 10 minutes and then heated to 85° C. over 60 minutes. At 85±2° C., the mixture was stirred from 0.5 to 3 hours, so that the particle diameter increased under salting-out/fusion. Subsequently, 2.1 liters of pure water was added, to terminate the increase in the particle diameter.

Placed into a 5-liter reaction vessel, fitted with a thermal sensor, a cooling pipe, and a particle diameter and shape monitoring device (Being the reaction apparatus which is shown in FIG. 11 in which the crossed axis angle α is set at 20 degrees) were 5.0 kg of the fused particle dispersion prepared as described above, and the shape was controlled while stirring at the dispersion temperature of 85±2° C. from 0.5 to 15 hours. Thereafter, the resultant dispersion was cooled to not more than 40° C. and stirring was terminated. Subsequently, classification was carried out in the suspension by a centrifugal sedimentation method employing a centrifuge, and the resultant mixture was filtered employing a 45 μm opening sieve. The resultant filtrate was designated as Association Liquid (1). Subsequently, wet cake-like non-spherical particles were collected from said Association Liquid (1) through filtration, employing glass filter and then washed with deionized water.

The resultant non-spherical particles were dried employing a flash jet drier at an intake air temperature of 60° C., and subsequently dried at 60° C., employing a fluidized-bed dryer. Externally blended with 100 parts, by weight, of the obtained colored particles were one part by weight of fine silica particles and 0.1 part by weight of zinc stearate, employing a Henschel mixer, and thus toners shown in the table below were obtained which were prepared employing the emulsion polymerization association method. Toner Ti as well as Toner T2 shown in Table 1 was obtained by controlling the stirring rotation rate and the heating time during monitoring of said salting-out/fusion stage as well as the shape controlling process, and further by adjusting the particle diameter and the variation coefficient of the grain size distribution.

Production of Toner T3 (Example of Suspension Polymerization Method)

A mixture consisting of 165 g of styrene, 35 g of n-butyl acrylate, 10 g of carbon black, 2 g of di-t-butylsalicylic acid metal compound, 8 g of styrene-methacrylic acid copolymer, and 20 g of paraffin wax (having an mp of 70° C.) was uniformly dissolved and dispersed at 12,000 rpm, employing TK Homomixer (manufactured by Tokushu Kikakogyo Co.). Added to the resultant mixture were 10 g of 2,2'-azobis(2,4-valeronitrile) and dissolved to prepare a polymerizable monomer composition. Subsequently, added to 710 g of deionized water were 450 g of 0.1 M aqueous sodium phosphate solution, and while stirring the resultant mixture at 13,000 rpm employing TK Homomixer, 68 g of 1.0 M calcium chloride were gradually added. Thus, a suspension, in which tricalcium phosphate was dispersed, was prepared. Added to the resultant suspension was said polymerizable monomer composition and the resultant mixture was stirred at 10,000 rpm for 20 minutes, employing TK Homomixer. Thus said polymerizable monomer composition was granulated. Thereafter, the granulated composition underwent reaction at 75 to 95° C. from 5 to 15 hours, employing a reaction apparatus having stirring blades (having a crossed axis angle of 45 degrees) structured as shown in FIG. 4. Subsequently, tricalcium phosphate was removed employing hydrochloric acid, and classification was then carried out in the liquid employing a centrifuge. Subsequently, filtering, washing and drying were carried out. Externally added to 100 weight parts of said obtained colored particles were one weight part of fine silica particle and 0.1 weight part of zinc stearate, employing a Henschel mixer. Thus obtained was a toner, which was prepared employing the suspension polymerization method.

Toner T3, which is shown in Table 1 described below, was obtained by carrying out monitoring during said polymerization, controlling the shape as well as the variation coefficient of the shape coefficient by controlling the temperature of said suspension, the rotation rate of stirring, and the heating time, and further by adjusting the particle diameter as well as the variation coefficient of the particle size distribution.

TABLE 1

| Toner No. | Ratio of Shape Coefficient of 1.0 to 1.6 (in percent) | Ratio of Shape Coefficient of 1.2 to 1.6 (in percent) | Variation Coefficient of Shape Coefficient (in percent) | Ratio of Toner Particles having no Coroners (in percent) | Number Average Particle Diameter (in μm) | Variation Coefficient of Number Distribution (in percent) | Sum M of $m_1$ and $m_2$ (in percent) | Production Method |
|---|---|---|---|---|---|---|---|---|
| Toner 11 | 76.6 | 72.0 | 14.9 | 53 | 6.4 | 26.2 | 77.0 | emulsion polymerization association |
| Toner 12 | 75.6 | 70.6 | 15.3 | 58 | 6.3 | 25.8 | 78.1 | emulsion polymerization association |
| Toner 13 | 89.5 | 76.9 | 14.8 | 61 | 8.9 | 26.6 | 77.8 | suspension poly-merization |

Preparation of Developer

Preparation of Developer 1

Mixed with 100 parts of said T1 were 0.4 part of hydrophobic silica particles having an average particle diameter of 12 nm (R805, manufactured by Nihon Aerosil Co.) and 0.6 part of titania particles (T805, manufactured by Nihon Aerosil Co.), and the resultant mixture was blended at room temperature at a peripheral stirring blade rate of 40 m/second for 10 minutes to obtain a negatively charged toner. The sticking ratio of the resultant toner was 45 percent.

A ferrite carrier having a volume average particle diameter of 60 μm, which had been coated with silicon resins, was blended with said toner, and Developer 1, having a toner concentration of 5 percent, was prepared.

Preparation of Developers 2 and 3

Developer 2 was repapered in the same manner as Developer 1, except that in the preparation of said Developer 1, Toner T1 was replaced with Toner T2, while Developer 3 was also prepared in the same manner, except that Toner T1 was replaced with Toner T3.

The cleaning blade member as well as the plastic member which is employed in the cleaning device of the present invention is described in the examples. Primarily employed as said cleaning blade members, as well as said plastic member, were commercially available products. However, those, which were not commercially available, were prepared employing newly prepared urethane rubber.

Said new urethane rubber was prepared as follows. Employed as raw materials of urethane prepolymers were ethylene adipate based prepolymers (having an Mn of 2,000 and an NCO ratio of 6 percent). Blended with said prepolymers were 4-butanediol and trimethylolpropane, while optionally varying the blending ratio, and the resultant mixture was poured into a die which had been preheated and was thermally hardened. Thus plastic members, having various different hardness and impact resilience, were prepared, and molded. After molding, resultant products were cut and machined to specified width, thickness and length.

Said plastic member, as well as said cleaning blade member, was adhered onto a support plate employing a hot-melt adhesive, and cleaning blade members employed in examples were obtained.

Example 1

Modification of plastic material and free length of the cleaning blade

Configuration: Plastic material and cleaning blade are adhered to a support member material as shown in FIG. 2. Free length L1 of cleaning blade and free length L2 of plastic material were varied as shown in Tables 2 and 3.

Other Cleaning Conditions

Cleaning blade contact angle: 20°

Cleaning blade load (N/m): 25 N/m

Evaluation of Cleaning Properties

As shown in Tables 2 and 3, the free length of the cleaning blade member and the plastic member was optionally varied, and by employing a digital copier, Konica 7050, (comprising processes utilizing corona charging, laser beam exposure, reversal development, electrostatic transfer, claw separation, and a cleaning blade member), which basically has image forming processes in described in FIG. 1., was carried out evaluation of toner which was not removed by the cleaning blade member, blade curl, blade noise, and image unevenness. The evaluation was carried out in such a manner that employing an original comprised of equal quarters of each of a text image having a pixel ratio of 7 percent, a halftone photographic image, a solid white image, and a solid black image, copying experiments were continuously carried out at normal temperature and normal humidity (24° C. and 60 percent RH) at a copying rate of 50 A4 sheets/minute for 90 minutes. Incidentally, prior to the beginning of said evaluation, in order to allow the photoreceptor as well as the cleaning blade member to adapt to processing, setting powder was scattered onto both surfaces and the photoreceptor was allowed to rotate for one minute. Other conditions for image evaluation are described below. Tables 2 and 3 show the evaluation results.

Other Conditions for Evaluation

Further, set as other evaluation conditions to employ said 7050 were conditions described below.

Charging Conditions

Charging unit: Scorotron charging unit, in which the initial electrostatic potential was set at −750 V.

Exposure Conditions

Exposure amount was set so that electric potential at the exposed part was −50 V Development Conditions DC bias: −550 V Dsd: 550 $\mu$m Developer layer regulation: edge cut system Developer thickness: 700 $\mu$m Developing sleeve diameter: 40 mm Transfer Conditions Transfer pole: corona charging system, transfer dummy electric current value: 45 $\mu$A Evaluation Items and Evaluation Criteria Non-removed toner A: non-removed development toner was observed B: 0 to 20 percent of development toner was not removed C: 20 to 50 percent of development toner was not removed D: at least 50 percent of development toner was not removed.

Blade curl

Time when the blade curl occurred was noted.

Blade noise

Abnormal noise which was generated by abnormal friction, between the cleaning blade member and the photoreceptor was designated as blade noise. The presence and absence of said abnormal noise was recorded.

Evaluation of Image Quality (Presence/Absence of Image Unevenness)

During said continuous copying of the halftone photographic image for 90 minutes, the formation of image unevenness was evaluated.

Condition in Table 2

Photoreceptor: P1

Cleaning Blade: Thickness $t_1$ of 2 mm, Manufactured by Hokushin Kogyo Co., having hardness of 70°, impact resilience of 60%.

Cleaning Blade: Thickness $t_1$ of 2 mm, Made by Hokushin Kogyo Co., having hardness of 70°, resilient plasticity 60%.

Plastic material: Polyethyleneterephthalate having thickness $t_2$ of 0.1 mm.

TABLE 2

| | | | | | | | | | | |
|---|---|---|---|---|---|---|---|---|---|---|
| L1 (in mm) | 9 | 9 | 9 | 9 | 9 | 9 | 9 | 9 | 9 | 9 |
| L2 (in mm) | 0.45 | 0.9 | 1.8 | 2.7 | 4.5 | 5.4 | 6.3 | 7.2 | 8.1 | 9 |
| L2/L1 | 0.05 | 0.1 | 0.2 | 0.3 | 0.5 | 0.6 | 0.7 | 0.8 | 0.9 | 1.0 |
| Blade Curl | not formed | not formed | not formed | not formed | not formed | not formed | not formed | not formed | not formed | Formed after 20 min. |
| Non-removed Toner | C | B | A | A | A | A | A | A | A | A |
| Blade Noise | Generated | Slightly Generated | None | None | None | None | None | None | None | Slightly Generated |
| Image Unevenness | Found | Slightly Found | None | None | None | None | None | None | None | Slightly Found |

Condition in Table 3

Photoreceptor: P2

Cleaning Blade: Thickness $t_1$ 2 mm, Manufactured by Hokushin Kogyo Co., having hardness of 67°, impact resilience of 50%.

Plastic material: Polyethyleneterephthalate having thickness $t_2$ of 0.1 mm.

TABLE 3

| | | | | | | | | | | |
|---|---|---|---|---|---|---|---|---|---|---|
| L1 (in mm) | 5 | 5 | 5 | 5 | 5 | 5 | 5 | 5 | 5 | 5 |
| L2 (in mm) | 0.25 | 0.5 | 1.0 | 1.5 | 2.5 | 3.0 | 3.5 | 4.0 | 4.5 | 5 |
| L2/L1 | 0.05 | 0.1 | 0.2 | 0.3 | 0.5 | 0.6 | 0.7 | 0.8 | 0.9 | 1.0 |
| Blade Curl | not formed | not formed | not formed | not formed | not formed | not formed | not formed | not formed | not formed | Formed after 10 min. |
| Non-removed Toner | D | B | A | A | A | A | A | A | A | A |
| Blade Noise | Generated | Slightly Generated | None | None | None | None | None | None | None | Slightly Generated |
| Image Unevenness | Found | Slightly Found | None | None | None | None | None | None | None | Slightly Found |

As can clearly be seen from Tables 2 and 3, when the free length of the plastic member as well as the cleaning blade member satisfies the conditions of Formula 1, that is 0.1<L2/L1≦0.9, neither non-removed toner nor the blade noise was formed and excellent cleaning properties were exhibited. In addition, no formation of the image unevenness was observed. On the other hand, when either 0.1≧L2/L1 or L2/L1>0.9 is held, any of non-removed toner and blade curl occurred.

TABLE 4

| | | | | | | | | | | |
|---|---|---|---|---|---|---|---|---|---|---|
| L1 (in mm) | 2 | 2 | 2 | 2 | 2 | 2 | 2 | 2 | 2 | 2 |
| L2 (in mm) | 0.025 | 0.04 | 0.07 | 0.1 | 0.5 | 1 | 1.5 | 2 | 3 | 4 |
| L2/L1 | 1/80 | 1/50 | 1/30 | 1/20 | 1/4 | 1/2 | 3/4 | 1 | 3/2 | 2 |
| Blade Curl | not formed | not formed | not formed | not formed | not formed | not formed | not formed | not formed | Formed after 25 min. | Formed after 10 min. |
| Non-removed Toner | C | A | A | A | A | A | A | A | A | A |
| Blade Noise | Generated | None | None | None | None | None | None | None | Slightly Generated | Generated |
| Image Unevenness | Found | None | None | None | None | None | None | None | Slightly Found | Found |

Example 2

Modification of plastic material and thickness of the cleaning blade

Configuration: Plastic material and cleaning blade are adhered to a support member material as shown in FIG. 2. Thickness $t_1$ of cleaning blade and thickness $t_2$ of plastic material are varied as shown in Table 4.

Cleaning blade contact angle: 20°

Cleaning blade load (N/m): 2 N/m

Evaluation of Cleaning Properties

As shown in Table 4, the thickness $t_1$ of cleaning blade and thickness $t_2$ of plastic material were varied, and by employing a digital copier, Konica 7050, (comprising processes utilizing corona charging, laser beam exposure, reversal development, electrostatic transfer, claw separation, and a cleaning blade member), which basically has image forming processes in described in FIG. 1., was carried out evaluation of toner which was not removed by the cleaning blade member, blade curl, blade noise, and image unevenness. Other conditions for image evaluation are same as Example 1. Table 4 shows the evaluation results.

Conditions in Table 4

Photoreceptor: P3

Developer: 3 (Toner: T3)

Cleaning blade member: rubber hardness of 70°, rubber having an impact resilience of 28 percent (manufactured by Hokushin Kogyo Co.) and a free length L1 of 9 mm Plastic material member: Polyethyleneterephthalate having a free length L2 of 5.4 mm As can clearly be seen from Table 4, when the free length of the plastic member as well as the cleaning blade member satisfies the conditions of Formula 1, that is $1/50<t_2/t_1<1$, neither non-removed toner nor the blade noise was formed and excellent cleaning properties were exhibited. In addition, no formation of the image unevenness was observed. On the other hand, when either $1/50>t_2/t_1$ or $t_2/t_1>1$ is held, any of non-removed toner and blade curl occurred.

Variation of plastic modulus of plastic member and cleaning blade

The plastic member and the cleaning blade are adhered to a supporting member as shown in FIG. 2. Plastic modulus $D_1$ and $D_2$ of the plastic member and cleaning blade were varied as shown in Table 5.

Cleaning blade member contact angle: 20°

Cleaning blade member load (N/m): 2 N/m

Evaluation of Cleaning Properties

As shown in Table 4, the plastic modulus of the cleaning blade member as well as the plastic member was varied, and by employing a digital copier Konica 7050 (comprising processes utilizing corona charging, laser beam exposure, reversal development, electrostatic transfer, claw separation, and cleaning blade member) which basically had image forming processes in described in FIG. 1, were carried out evaluation of cleaning properties of toner which was not removed by the cleaning blade member, blade curl, blade noise, as well as the image unevenness. Table 5 shows the evaluation results.

Condition in Table 5

Photoreceptor: P3

Developer: 1 (Toner: T1)

Cleaning Blade: Free length L1: mm, and thickness $t_1$:2 mm

Plastic member: Free lenth L2: 5.4 mm, and thickness $t_2$: 2 mm

TABLE 5

| | | | | | | | | | | |
|---|---|---|---|---|---|---|---|---|---|---|
| $D_1$ | 0.7 | 0.7 | 0.4 | 0.4 | 0.4 | 0.4 | 0.4 | 0.4 | 0.1 | 0.1 |
| $D_2$ | 10 | 11 | 50 | 100 | 300 | 500 | 1000 | 1500 | 2800 | 3500 |
| $D_2/D_1$ | 14 | 16 | 125 | 250 | 750 | 1250 | 2500 | 3750 | 28000 | 35000 |
| Blade Curl | Formed after 20 min. | not formed | not formed | not formed | not formed | not formed | not formed | not formed | not formed | not formed |
| Non-removed Toner | C | A | A | A | A | A | A | A | A | C |
| Blade Noise | Generated | None | None | None | None | None | None | None | None | Generated |
| Image Unevenness | Found | None | None | None | None | None | None | None | None | Found |

As can clearly be seen from Table 5, when the plastic modulus of the plastic member, as well as of the cleaning blade member, satisfies the conditions of Formula 3, that was $16 \leqq D_2/D_1 \leqq 28{,}000$, non-removed toner, blade noise, and image unevenness did not result. On the other hand, when either $16 > D_2/D_1$ or $D_2/D_{1>28{,}000}$ held true, non-removed toner and blade curl was observed.

Example 4

Variation of tensile strength H of the plastic member

Plastic member: Plastic member having various tensile strength H shown in Table 6.

Plastic member and cleaning blade are adhered to a support shown in FIG. 2, wherein tensile strength H of plastic member was varied as shown in Table 6.

Cleaning blade member contact angle: 20°

Cleaning blade member load (N/m): 2 N/m

Evaluation of Cleaning Properties

As shown in Table 6, the plastic modulus of the cleaning blade member as well as the plastic member was varied, and by employing a digital copier Konica 7050 (comprising processes utilizing corona charging, laser beam exposure, reversal development, electrostatic transfer, claw separation, and cleaning blade member) which basically had image forming processes in described in FIG. 1., were carried out evaluation of cleaning properties of toner which was not removed by the cleaning blade member, blade curl, blade noise, as well as the image unevenness. Table 6 shows the evaluation results.

Condition in Table 6

Photoreceptor: P3

Developer: 1 (Toner: T1)

Cleaning blade member: rubber hardness of 67°, rubber having an impact resilience of 50 percent (manufactured by Hokushin Kogyo Co.), free length L1 of 9 mm, and thickness $t_1$ of 2 mm Plastic member: the plastic member, having free length L2 of 5.4 mm and thickness $t_2$ of 0.1 mm.

As can clearly be seen from Table 6, when the tensile strength of the plastic member, satisfies the conditions of Formula 4, that was $1.4 \leqq H \leqq 35$, non-removed toner, blade noise, and image unevenness did not result. On the other hand, when either $1.4 > H$ or $H > 35$ held true, non-removed toner, blade curl and image unevenness were observed.

Example 5

Variation of the bending strength M of the plastic member

Plastic member: Plastic member having various bending strength M shown in Table 7.

Plastic member and cleaning blade are adhered to a support shown in FIG. 2, wherein bending strength M of plastic member was varied as shown in Table 6.

Cleaning blade member contact angle: 20°

Cleaning blade member load (N/m): 2 N/m

Evaluation of Cleaning Properties

As shown in Table 7, the plastic modulus of the cleaning blade member as well as the plastic member was varied, and by employing a digital copier Konica 7050 (comprising processes utilizing corona charging, laser beam exposure, reversal development, electrostatic transfer, claw separation, and cleaning blade member) which basically had image forming processes in described in FIG. 1, were carried out evaluation of cleaning properties of toner which was not removed by the cleaning blade member, blade curl, blade noise, as well as the image unevenness. Table 7 shows the evaluation results.

Condition in Table 7

Photoreceptor: P3

Developer: 2 (Toner: T2)

Cleaning blade member: rubber hardness of 67°, rubber having an impact resilience of 50 percent (manufactured by Hokushin Kogyon Co.), free length L1 of 9 mm, and thickness $t_1$ of 2 mm Plastic member: the plastic member, having free length L2 of 5.4 mm and thickness $t_2$ of 1 mm.

TABLE 6

| H | 0.7 | 1.4 | 3 | 5 | 7 | 9 | 15 | 21 | 35 | 40 |
|---|---|---|---|---|---|---|---|---|---|---|
| Blade Curl | not formed | not formed | not formed | not formed | not formed | not formed | not formed | not formed | not formed | after 15 mm. |
| Non-removed Toner | C | A | A | A | A | A | A | A | A | A |
| Blade Noise | Generated | None | None | None | None | None | None | None | None | Slightly Generated |
| Image Unevenness | Found | None | None | None | None | None | None | None | None | Slightly Found |

TABLE 7

| M | 0.95 | 3 | 5 | 10 | 15 | 20 | 30 | 35 | 39 | 42 |
|---|---|---|---|---|---|---|---|---|---|---|
| Blade Curl | not formed | not formed | not formed | not formed | not formed | not formed | not formed | not formed | not formed | Formed after 15 min. |
| Non-removed Toner | C | A | A | A | A | A | A | A | A | A |
| Blade Noise | Generated | None | None | None | None | None | None | None | None | Slightly Generated |
| Image Unevenness | Found | None | None | None | None | None | None | None | None | Slightly Found |

As can clearly be seen from Table 7, when the tensile strength of the plastic member, satisfies the conditions of Formula 4, that was $0<M\leqq 41$, non-removed toner, blade noise, and image unevenness did not result. On the other hand, when $M>35$ held true, non-removed toner and blade curl as well as image unevenness were observed.

Example 6

Example Conditions 1 through 9

Photoreceptors, developers and cleaning conditions were combined as shown in Table 8.

Variation of combinations of the plastic member and the cleaning blade members

Configuration: combinations of materials, the free length, and the thickness of the cleaning blade member as well as the plastic member were varied, and as a result, values of formulas 1 through 5 also varied.

Cleaning blade member contact angle: described in Table 8

Cleaning blade member load (N/m): described in Table 8

Evaluation of Cleaning Properties

As shown in Table 8, the combination of the photoreceptor, the toner, the cleaning blade member and the plastic member was varied, and by employing a digital copier, Konica 7050 (comprising processes utilizing corona charging, laser beam exposure, reversal development, electrostatic transfer, claw separation, and cleaning blade member) which basically had image forming processes in described in FIG. 1, was carried out for evaluation of the toner which was not removed by the cleaning blade member, blade curl, and blade noise, and image unevenness of halftone photographic images was also evaluated. Evaluation conditions were the same as Example 1. Table 8 shows conditions of the example, and Table 9 shows the evaluation results.

TABLE 9

| Example | Evaluation Item | | | |
|---|---|---|---|---|
| Condition No. | Non-removed Toner | Blade Curl | Blade Noise (generation of abnormal noise) | Image Unevenness |
| 1 | A | not formed | not generated | not formed |
| 2 | A | not formed | not generated | not formed |
| 3 | A | not formed | not generated | not formed |
| 4 | A | not formed | not generated | not formed |
| 5 | A | not formed | not generated | not formed |
| 6 | A | not formed | not generated | not formed |
| 7 | C | Formed after 30 minutes | Generated | Formed |
| 8 | C | Formed after 40 minutes | Generated | Formed |

As can clearly be seen from Tables 8 and 9, for combinations of the plastic member and the cleaning blade member, example conditions 1 through 6, which satisfied the conditions of Formulas 1 through 5, resulted in neither blade curl nor non-removed toner, and exhibited excellent cleaning properties. Further no image unevenness was formed. On the other hand, example conditions 7 and 8, which did not satisfy Formulas 1 through 5, resulted in at least either

TABLE 8

| | Example Conditions | | | | | | | | |
|---|---|---|---|---|---|---|---|---|---|
| Example Condition No. | Photoreceptor No. | Toner No. | Blade Contact Angle (in degrees) | Blade Contact Load (in N/m) | Formula 1: L2/L1 | Formula 2: $t_2/t_1$ | Formula 3: $D_2/D_1$ | Formula 4: H | Formula 5: M |
| 1 | P1 | T1 | 15 | 20 | 0.7 | 0.02 | 280 | 3 | 0.95 |
| 2 | P2 | T2 | 20 | 30 | 0.7 | 0.05 | 750 | 8 | 5 |
| 3 | P3 | T3 | 25 | 10 | 0.7 | 0.5 | 1250 | 5 | 20 |
| 4 | P1 | T2 | 25 | 30 | 0.5 | 0.02 | 1250 | 5 | 20 |
| 5 | P2 | T3 | 15 | 10 | 0.5 | 0.05 | 750 | 8 | 5 |
| 6 | P3 | T1 | 20 | 20 | 0.5 | 0.5 | 28 | 3 | 0.95 |
| 7 | P2 | T1 | 15 | 10 | 0.1 | 0.025 | 14 | 0.7 | 0.5 |
| 8 | P3 | T2 | 25 | 30 | 0.9 | 1 | 14 | 0.7 | 0.5 |

non-removed toner, blade curl, and blade noise, and image unevenness, as well as image unevenness were also formed.

As can clearly be seen from the aforementioned examples, by employing a cleaning device which comprises a cleaning blade member which is adhered with a plastic member under the conditions of the present invention, it is possible to effectively remove the residual toner on the photoreceptor without resulting in blade curl and non-removed toner. Further, it is possible for the present invention to provide an image forming method as well as an image forming apparatus, employing said cleaning device.

What is claimed is:

1. A cleaning device removing residual toner from a photoreceptor wherein the cleaning device comprises a cleaning blade composed of a plurality of plate materials laminated together, the plurality of plate materials including a cleaning blade member and a plastic member each of which is mounted on a support member, the cleaning blade member being brought into contact with said photoreceptor and the plastic member not being brought into contact with said photoreceptor, wherein elastic modulus of the cleaning blade $D_1$ and the elastic modulus of the plastic member $D_2$ satisfy $$16 \leqq D_2/D_1 \leqq 2{,}800.$$

2. The cleaning device of claim 1 wherein tensile strength H of the plastic member satisfies $$1.4 \leqq H \leqq 35 \text{ (H: kgf/mm}^2\text{)}.$$

3. The cleaning device of claim 1 wherein bending strength M of the plastic member satisfies $$0 < M \leqq 41 \text{ (M: kgf/mm}^2\text{)}.$$

4. The cleaning device of claim 1 wherein length $L_1$ of the cleaning blade member is longer than length $L_2$ of the plastic member.

5. The cleaning device of claim 1 wherein the cleaaning member and the plastic member are laminated with an adhesive layer.

6. The cleaning device of claim 1, wherein the cleaning device satisfies;

$$0.1 < L2/L1 \leqq 0.9$$

wherein L1 is a free length of the cleaning blade member and L2 is a free length of the plastic member, $$1/50 < t_2/t_1 < 1$$

wherein $t_1$ is a thickness of the cleaning blade member and $t_2$ is a thickness of the plastic member, and $$1.4 \leqq H \leqq 35 \text{ (H: kgf/mm}^2\text{)}$$

wherein H is tensile strength of the plastic member.

7. The cleaning device of claim 6 wherein L2/L1 is 0.3 to 0.7.

8. The cleaning device of claim 1, wherein the cleaning device satisfies;

$$0.1 < L2/L1 \leqq 0.9$$

wherein L1 is a free length of the cleaning blade member and L2 is a free length of the plastic member, $$1/50 < t_2/t_1 < 1$$

wherein $t_1$ is a thickness of the cleaning blade member and $t_2$ is a thickness of the plastic member, and $$0 < M \leqq 41 \text{ (M: kgf/mm}^2\text{)}$$

wherein bending M is bending strength of the plastic member.

9. A cleaning device removing residual toner from a photoreceptor wherein the cleaning apparatus comprises a cleaning blade composed of a plurality of plate material laminated each other, the plurality of plate material including a cleaning blade member and a plastic member each of which is mounted on a support member, the cleaning blade member being brought into contact with said photoconductor and the plastic member not being brought into contact with said photoconductor, wherein length $L_1$ of the cleaning blade member is longer than length $L_2$ of the plastic member; and wherein elastic modulus of the cleaning blade $D_1$, and the elastic modulus of the plastic member $D_2$ satisfy $$16 \leqq D_2/D_1 \leqq 2{,}800.$$

10. An image forming method comprising steps of charging a photoreceptor uniformly, imagewise exposing the photoreceptor to form a latent image, developing the latent image by toner to form a toner image, transferring the toner image to a recording material, fixing the transferred toner image and cleaning residual toner on the photoreceptor with a cleaning device, wherein the cleaning device comprises a cleaning blade composed of a plurality of plate materials laminated together, the plurality of plate materials including a cleaning blade member and a plastic member each of which is mounted on a support member, the cleaning blade member being brought into contact with said photoreceptor and the plastic member not being brought into contact with said photoreceptor, and the cleaning blade satisfies one of following conditions;

$$0.1 < L2/L1 \leqq 0.9$$

wherein L1 is free length of a cleaning blade member and L2 is free length of the plastic member, $$1/50 < t_2/t_1 < 1$$

wherein $t_1$ is thickness of the cleaning blade member and $t_2$ is thickness of the plastic member, $$1.4 \leqq H \leqq 35 \text{ (H: kgf/mm}^2\text{)}$$

wherein H is tensile strength of the plastic member; and $$16 \leqq D_2/D_1 \leqq 2{,}800$$

wherein $D_1$ is elastic modulus of the cleaning blade and $D_2$ is elastic modulus of the plastic member.

11. An image forming method of claim 10 wherein toner has a variation coefficient of a shape coefficient of toner particles of not more than 16 percent, and a number variation coefficient of a number size distribution of said toner particles of not more than 27 percent.

12. An image forming method comprising steps of charging a photoreceptor uniformly, imagewise exposing to form a latent image, developing the latent image by toner to form a toner image, transferring the toner image to a recording material, fixing transferred toner image and cleaning a residual toner on the photoreceptor by a cleaning device, wherein the cleaning device comprises a cleaning blade composed of a plurality of plate materials laminated together, the plurality of plate materials including a cleaning blade member and a plastic member each of which is mounted on a support member, the cleaning blade member being brought into contact with said photoreceptor and the plastic member not being brought into contact with said photoreceptor, and the cleaning blade satisfies one of following conditions;

$$0.1<L2/L1\leqq 0.9$$

wherein L1 is free length of a cleaning blade member and L2 is free length of a plastic member, $$1/50<t_2/t_1<1$$

wherein $t_1$ is thickness of the cleaning blade member and $t_2$ is thickness of the plastic member, and $$0<M\leqq 41\ (M:\ kgf/mm^2)$$

wherein bending M is bending strength of the plastic member; and $$16\leqq D_2/D_1\leqq 2{,}800$$

wherein $D_1$ is elastic modulus of the cleaning blade and $D_2$ is elastic modulus of the plastic member.

13. The image forming apparatus of claim 12 wherein contact angle θ of the cleaning blade member against the photoreceptor is not less than 10 degrees.

14. An image forming apparatus comprising a photoreceptor, an exposing unit to form a latent image on the photoreceptor, developing unit to visualize toner image, a transferring unit to transfer visualized toner image to a recording material, a fixing unit to fix the transferred toner image on the recording material and a cleaning device to clean residual toner from the photoreceptor, wherein the cleaning device comprises a cleaning blade composed of a plurality of plate materials laminated together, the plurality of plate material including a cleaning blade member and a plastic member each of which is mounted on a support member, the cleaning blade member being brought into contact with said photoreceptor and the plastic member not being brought into contact with said photoreceptor, and the cleaning blade satisfies one of following conditions;

$$0.1<L2/L1<0.9$$

wherein L1 is free length of a cleaning blade member and L2 is free length of a plastic member, $$1/50<t_2/t_1<1$$

wherein $t_1$ is thickness of the cleaning blade member and $t_2$ is thickness of the plastic member, $$1.4\leqq H\leqq 35\ (H:\ kgf/mm^2)$$

wherein H is tensile strength of the plastic member; and $$16\leqq D_2/D_1\leqq 2{,}800$$

wherein $D_1$ is elastic modulus of the cleaning blade and $D_2$ is elastic modulus of the plastic member.

* * * * *